US011548176B2

(12) United States Patent
Krauss et al.

(10) Patent No.: US 11,548,176 B2
(45) Date of Patent: Jan. 10, 2023

(54) ELECTRICALLY-DRIVEN DEVICE CONSTRUCTED TO RECEIVE A PLURALITY OF ATTACHMENTS

(71) Applicant: Braun GmbH, Kronberg (DE)

(72) Inventors: Joachim Krauss, Seeheim-Jugenheim (DE); Thorsten Piesker, Friedrichsdorf (DE); Johannes Stimpel, Wiesbaden (DE); Anja Weigel, Idstein (DE); Wolfgang Stegmann, Frankfurt am Main (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 15/717,186

(22) Filed: Sep. 27, 2017

(65) Prior Publication Data

US 2018/0085949 A1 Mar. 29, 2018

(30) Foreign Application Priority Data

Sep. 28, 2016 (EP) ..... 16191109

(51) Int. Cl.
*B26B 19/28* (2006.01)
*B26B 19/38* (2006.01)
*B26B 19/04* (2006.01)

(52) U.S. Cl.
CPC ..... *B26B 19/28* (2013.01); *B26B 19/048* (2013.01); *B26B 19/386* (2013.01); *B26B 19/3813* (2013.01)

(58) Field of Classification Search
CPC . B26B 19/3826; B26B 19/3806; B26B 19/28; B26B 19/19; B26B 19/386;
(Continued)

(56) References Cited

U.S. PATENT DOCUMENTS 2,249,293 A * 7/1941 King ..... B26B 19/42 30/133
3,672,049 A * 6/1972 Demci ..... B26B 19/10 30/221

(Continued)

FOREIGN PATENT DOCUMENTS

CN 101554733 A 10/2009
CN 103702650 A 4/2014

(Continued)

OTHER PUBLICATIONS

European search report dated Mar. 23, 2017.

(Continued)

*Primary Examiner* — Evan H MacFarlane
*Assistant Examiner* — Fernando A Ayala
(74) *Attorney, Agent, or Firm* — Gerd Zetterer; Kevin C. Johnson

(57) ABSTRACT

An electrically-driven device includes a handle and a head, wherein the head includes a head base coupled to the handle and movable in at least two dimensions relative to the handle and a first head attachment and a second head attachment, wherein each one of the first and second head attachments are releasably engageable, one at a time, with the head base, each one of the first and second head attachments includes a skin treatment implement constructed to treat skin or a cutting unit constructed to cut hair, and the first head attachment is different from the second head attachment.

17 Claims, 13 Drawing Sheets

(58) Field of Classification Search
CPC ..... B26B 19/063; B26B 19/3846; B26B 19/3813; B26B 19/048
See application file for complete search history.

(56) References Cited

U.S. PATENT DOCUMENTS

| | | | | |
|---|---|---|---|---|
| 3,869,790 | A * | 3/1975 | Ihasz | B26B 19/06 30/537 |
| 4,125,940 | A * | 11/1978 | Ihasz | B26B 19/20 30/200 |
| 5,083,336 | A * | 1/1992 | Atsumi | A46B 5/0033 132/121 |
| 5,138,767 | A * | 8/1992 | Locke | B26B 19/04 30/41 |
| 5,193,275 | A * | 3/1993 | Hirokazu | B26B 19/04 30/43 |
| 5,606,799 | A * | 3/1997 | Melton | B26B 19/063 30/199 |
| 5,724,736 | A * | 3/1998 | Smith | B26B 19/44 30/133 |
| 6,044,558 | A | 4/2000 | Wu | |
| 6,378,210 | B1 * | 4/2002 | Bickford | B26B 19/3806 30/122 |
| 6,588,108 | B2 * | 7/2003 | Talavera | B26B 19/16 30/124 |
| 7,162,801 | B2 | 1/2007 | Royle | |
| 8,141,253 | B2 | 3/2012 | Royle | |
| 8,171,942 | B2 * | 5/2012 | Poran | A45D 26/00 132/75.8 |
| 9,266,245 | B2 * | 2/2016 | Kammer | B26B 19/386 |
| 9,597,811 | B2 * | 3/2017 | Talavera | B26B 19/22 |
| 2006/0021228 | A1 | 2/2006 | Shiba et al. | |
| 2011/0214289 | A1 | 9/2011 | Maichel et al. | |
| 2012/0005900 | A1 * | 1/2012 | Erndt | B26B 19/04 30/43.92 |
| 2018/0281213 | A1 * | 10/2018 | Eijkelkamp | B26B 19/386 |
| 2018/0319026 | A1 * | 11/2018 | Hayashi | B26B 19/046 |
| 2018/0319028 | A1 * | 11/2018 | Kraus | B26B 19/28 |

FOREIGN PATENT DOCUMENTS

| | | | |
|---|---|---|---|
| CN | 204954885 | U | 1/2016 |
| EP | 3037223 | A1 | 6/2016 |
| JP | 2010536460 | A | 12/2010 |
| JP | 5992520 | B2 | 9/2016 |

OTHER PUBLICATIONS

China First Search; China Application No. 2017800599113; dated Apr. 10, 2020; China National Intellectual Property Administration; People's Republic of China.
European Search Report; European Application No. 17192951; dated Mar. 2, 2018; European Patent Office; Munich, Germany.
International Preliminary Report on Patentability; PCT Application No. PCT/IB2017/055910; dated Apr. 2, 2019; The International Bureau of WIPO; Geneva, Switzerland.
Written Opinion and International Search Report; PCT Application No. PCT/IB2017/055910; dated Apr. 5, 2018; European Patent Office; Rijswijk, Netherlands.

* cited by examiner

ELECTRICALLY-DRIVEN DEVICE CONSTRUCTED TO RECEIVE A PLURALITY OF ATTACHMENTS

FIELD OF THE INVENTION

The present disclosure generally relates to an electrically-driven device constructed to receive a plurality of attachments for providing multiple options, convenience, ease and flexibility in a single device.

BACKGROUND OF THE INVENTION

Separate hair grooming (e.g., cutting, trimming, shaving, and/or stubbing hair from the head, face, and/or body) devices and separate skin treatment devices (e.g., skin exfoliating) are known in the prior art. There are a large number of different hair grooming devices that are designed according to different principles of operation.

Known electrically-driven devices, such as shavers and/or depilators shown and described in U.S. Pat. No. 7,162,801 and EP 3037223A1. Other examples of known electrically-driven devices are Braun Series 5 razors; typically include a single multi-functional head having several parts. For example, the functional head may include a cartridge having cutting units (e.g., foil-type cutting units and center-trimmers). The known electronically-driven devices are constructed to receive a single, specific functional head having specific type of cutting units. For example, one electronically-driven device may be constructed to have a cutting unit for specifically shaving, another electronically-driven device may be constructed to have a cutting unit for beard trimming, while another electronically-driven device may be constructed to have a cutting unit for body grooming, while another electrically-driven device may be constructed to have a brush for exfoliating the skin, and so on. As a further example, electrical shavers are typically designed to deliver the benefit of a "clean shave." In these conventional shavers, the mechanical requirements to operate a "clean shave" functional head are very specific and different to the mechanical requirements to operate, for example, a long hair trimmer, a beard trimmer, a beard stubble trimmer, an exfoliation brush, or other skin treatment implements. Attempts to adapt prior art electrically-driven devices for multiple functions have many disadvantages in terms of usability, performance, or convenience because this flexibility had not been designed into the device from the beginning, nor has the device been optimized for the multiple hair grooming and/or skin treatment functions. Thus, users of such prior art devices experience a drop off in performance when using such device to perform one or more of the hair grooming and/or skin treatment functions. For example, in performing some functions, the functional head of the electrically-driven device may need to be fixed relative to the handle in order to achieve maximum performance. In others, the functional head may need to tilt only (relative to the handle) to achieve maximum performance, and yet, in others, the functional head may need to tilt and swivel relative the handle to achieve maximum performance.

Thus, a user is required to possess multiple electrically-driven devices for each specific hair grooming and/or skin treatment purpose. Requiring multiple electrically-driven devices for each hair grooming and/or skin treatment adds additional expenses to the consumer, creates inconvenience to the consumer, and requires additional space for storage and charging of each of these individual electrically-driven devices.

What is desired is a single electrically-driven device that is able to interchange and receive multiple types of head attachments (i.e., cartridges), each head attachment may be constructed to perform a different duty or duties (e.g., long hair trimming, beard trimming, body grooming, facial hair stubble trimming to create razor stubble appearance, skin treatment (e.g., brushing, foliating), etc.). What is also desired is having fewer electronically-driven devices for performing multiple skin and hair grooming functions. What is also desired is an electrically-driven device that can translate rotary motion of the motor to linear, reciprocating motion in the head, even without the additional parts, such as, for example, an oscillating bridge.

SUMMARY OF THE INVENTION

In accordance with one embodiment, an electrically-driven device can include a handle; a head, the head including a head base being coupled to the handle and movable in at least two dimensions relative to the handle, and a first head attachment and a second head attachment, wherein each one of the first and second head attachments are releasably engageable, one at a time, with the head base, wherein each one of the first and second head attachments includes a skin treatment implement constructed to treat skin or a cutting unit constructed to cut hair, wherein the first head attachment is different from the second head attachment, and wherein each of the first head attachment and the second head attachment comprises a shaver head attachment, a long-hair trimmer head attachment, a body hair trimmer head attachment, a beard trimmer head attachment, a facial hair stubble trimmer head attachment, a skin treatment implement head attachment, or an anti-three-dimensional movement head attachment; at least one driven shaft, the at least one driven shaft extending into the head and coupled to and driving the skin treatment implement or cutting unit; a motor, the motor being contained substantially within the handle; and a transmission, the transmission being constructed to translate rotary motion of the motor to linear, reciprocating motion of the at least one driven shaft.

In accordance with another embodiment, a personal grooming kit can include an electrically-driven device, the device including a handle, a head base being coupled to the handle, at least one driven shaft extending upwardly into the head base; a motor, the motor being contained substantially within the handle, and transmission, the transmission being constructed to translate rotary motion of the motor to reciprocating motion of the at least one driven shaft; and a plurality of head attachments, each of the plurality of head attachments being releasably engageable, one at a time, with the head base, the plurality of head attachments comprising a first head attachment, a second head attachment, and a third head attachment; wherein the first head attachment is different from the second head attachment, and each of the first head attachment, second head attachment, and third head attachment is selected from the group consisting of a shaver head attachment, a long-hair trimmer head attachment, a body hair trimmer head attachment, a beard trimmer head attachment, a facial hair stubble trimmer head attachment, a skin treatment implement head attachment, and an anti-three-dimensional movement head attachment.

In accordance with yet another embodiment, an electrically-driven device can include a handle; a head including a head base that is coupled to the handle and movable in at least three dimensions relative to the handle, and a first head attachment and a second head attachment, wherein each one of the first and second head attachments are releasably engageable, one at a time, with the head base, each one of the first and second head attachments includes a skin treatment implement constructed to treat skin or a cutting unit constructed to cut hair, and each of the first head attachment and the second head attachment includes a shaver head attachment, a long-hair trimmer head attachment, a body hair trimmer head attachment, a beard trimmer head attachment, a facial hair stubble trimmer head attachment, or a skin treatment implement head attachment; a stop constructed to be selectively engageable to the head and handle to prevent movement in a third dimension when only one of the first head attachment is engaged to the head base, but not when the second head attachment is engaged to the head base after the first head attachment is disengaged from the head base; a motor, the motor being contained substantially within the handle; and a transmission, the transmission being constructed to translate rotary motion of the motor to linear, reciprocating motion of at least one driven shaft.

In accordance with still, yet another embodiment, an electrically-driven device can include a handle; a head that includes a head base being coupled to the handle and movable in at least two dimensions relative to the handle, and a skin treatment head attachment including a first brush unit and a second brush unit, both first and second brush units movably coupled to the skin treatment head attachment, a second head attachment including a skin treatment implement constructed to treat skin or a cutting unit constructed to cut hair, wherein each one of the skin treatment head attachment and the second head attachment is releasably engageable, one at a time, with the head base; a motor, the motor being contained at least partially within the handle; a transmission coupled to the motor; a first driven shaft coupled to the transmission, opposite the motor; and a second driven shaft coupled to the transmission, opposite the motor; wherein the transmission being constructed to translate rotary motion of the motor to linear, reciprocating motion of the first driven shaft and to the second driven shafts; wherein, when the skin treatment head attachment is releasably engaged to the head base, the first brush unit is coupled to an end of the first driven shaft, opposite the transmission, and the second brush unit is coupled to an end of the second driven shaft, opposite the transmission such that the first and second driven shafts reciprocate the respective first and second brush units in linear, opposite directions from each other along a transverse axis ($A_3$).

DETAILED DESCRIPTION OF THE INVENTION

Figure 1:
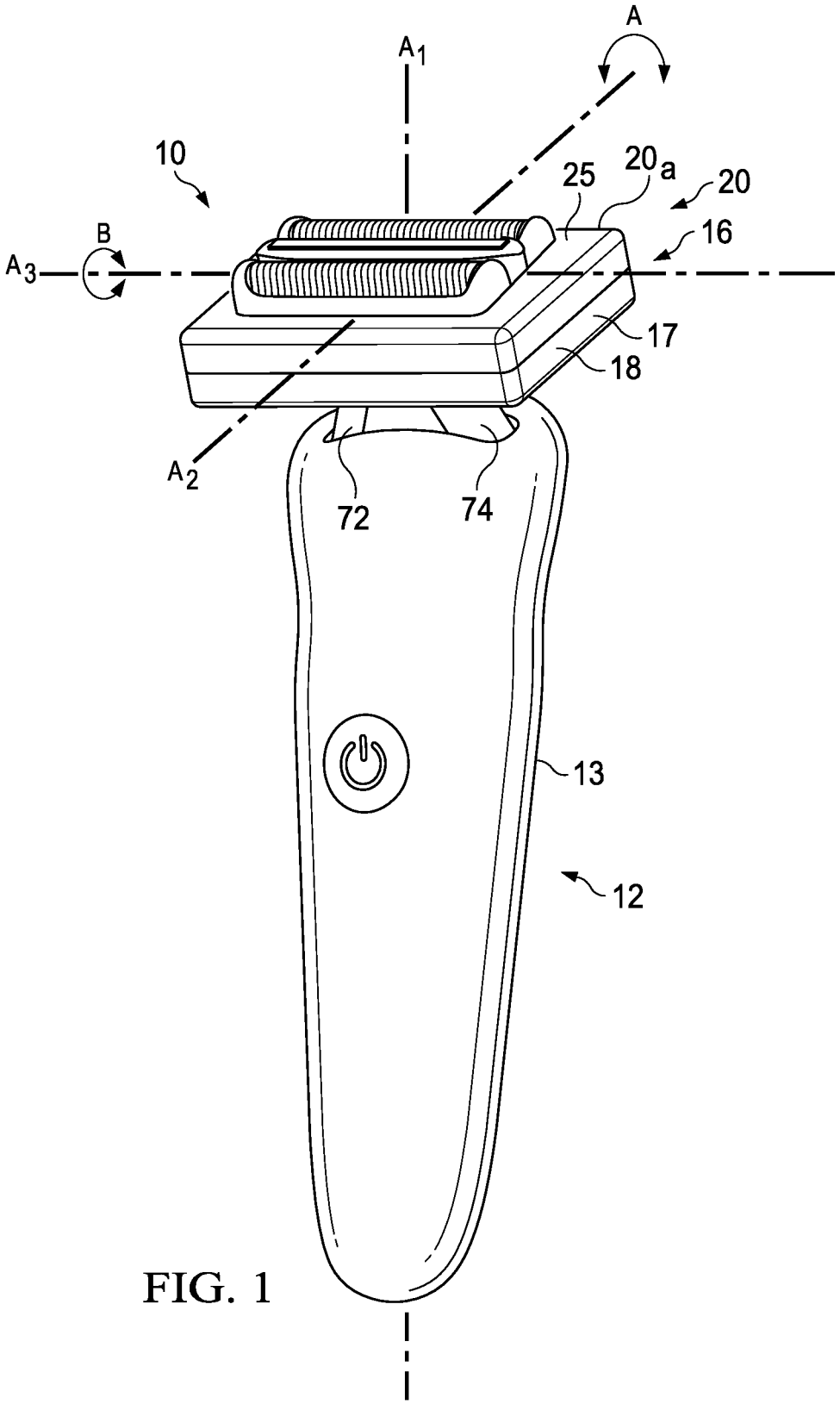
FIG. 1 depicts an isometric view of an electrically-driven device, according to one or more embodiments.

The following text sets forth a broad description of numerous different embodiments. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

In order to improve operability and ability to use a single electrically-driven device to perform multiple skin treatments and/or hair cutting functions for a user without sacrificing the functional performance of the device to perform the different skin treatments and/or hair cutting functions, an electrically-driven device can include a handle; a head, the head including a head base being coupled to the handle and movable in at least two dimensions relative to the handle, and a first head attachment and a second head attachment, wherein each one of the first and second head attachments are releasably engageable, one at a time, with the head base, wherein each one of the first and second head attachments includes a skin treatment implement constructed to treat skin or a cutting unit constructed to cut hair, wherein the first head attachment is different from the second head attachment, and wherein each of the first head attachment and the second head attachment comprises a shaver head attachment, a long-hair trimmer head attachment, a body hair trimmer head attachment, a beard trimmer head attachment, a facial hair stubble trimmer head attachment, a skin treatment implement head attachment, or an anti-three-dimensional movement head attachment; at least one driven shaft, the at least one driven shaft extending into the head and coupled to and driving the skin treatment implement or cutting unit; a motor, the motor being contained substantially within the handle; and a transmission, the transmission being constructed to translate rotary motion of the motor to linear, reciprocating motion of the at least one driven shaft.

In order to provide improved adaptability of the head to skin contour and to reduce a user's burden of adapting to skin contour through the handle, the head is movable in three dimensions relative to the handle.

In order to further improve convenience and reduce expenses for a user, the electrically-driven device can include a third head attachment, a fourth head attachment, a fifth head attachment, a sixth head attachment, a seventh head attachment, or combinations thereof, wherein each of the third head attachment, fourth head attachment, fifth head attachment, sixth head attachment, and a seventh head attachment comprise a shaver head attachment, a long-hair trimmer head attachment, a body hair trimmer head attachment, a beard trimmer head attachment, a facial hair stubble trimmer head attachment, a skin treatment implement head attachment, or an anti-three-dimensional movement head attachment.

In order to further improve adaptability and to provide a lightweight tilt mechanism and good flexing at various neck and facial positions, the electrically-driven device can include a link mechanism coupling the head to the handle such that the head tilts about a first transverse axis ($A_2$) relative to the handle.

In order to further improve adaptability and to provide a lightweight tilt mechanism and good flexing at various neck and facial positions, the link mechanism is a four link mechanism, each link has an upper portion movably coupled to the head and a lower portion movably coupled to the handle.

In order to further improve adaptability and to provide a lightweight swivel mechanism and good flexing at various neck and facial positions, the handle can include a first support member coupling the head to the handle such that the head swivels about a second transverse axis ($A_3$) relative to the handle.

In order to further improve adaptability of the head to skin contour, to reduce a user's burden of adapting to skin contour through the handle, and to provide an improved swivel mechanism, the first support member can include a first tab and a second tab, and wherein the head comprises a first end swivelably coupled to the first tab and a second end swivelably coupled to the second end.

In order to improve the performance of each head attachments function and convenience for a user, the electrically-driven device can further include a stop that engages both the head and handle, preventing the head from moving in a third dimension.

In order to further improve the interchangeability and convenience for a user, the first and second head attachments can include frame being releasably engageable with the head base; and a hood, the hood being releasably engageable with at least one of the head base or the frame.

In order to improve operability and the capability of the electrically-driven razor to receive and drive multiple, different functional head attachments, the at least one driven shaft comprises a first driven shaft and a second driven shaft.

In order to translate rotational movement of the drive shaft of the motor to linear, reciprocating motion of one or more cutting units or skin treatment implements and more effectively cut hair and/or treat the skin, the first head attachment can further include a post extending from the frame and a rocking arm pivotally coupled to the post and having a first end and a second end, the rocking arm being releasably engageable, at the first end, to one of the first driven shaft or the second driven shaft, and at the second end, to a cutter of the first head attachment, such that the rocking arm translates reciprocating motion of one of the first driven shaft or the second driven shaft to the cutter.

In order to more effectively capture and cut hairs and improve convenience for a user, the first head attachment can include one or more cutting units that is releasably coupled to the first driven shaft and the second driven shaft.

In order to more effectively shave and provide the "clean shaven" appearance to a user, the first head attachment is a shaver and the at least one of the one or more cutting units is a foil-type cutting unit.

In order to more effectively capture and cut hairs (e.g., trim beards) and improve convenience for a user, the first head attachment can further include a carrier that couples one of the first driven shaft or second driven shaft to a cutter.

In order to more effectively cut hairs at specific lengths and improve convenience for a user, the first head attachment or second head attachment further include one or more distance combs that are releasably engageable with the first head attachment or second head attachment.

In order to improve operability, convenience, and ability to use a single electrically-driven device to perform multiple skin treatments and/or hair cutting functions for a user, a personal grooming kit can include an electrically-driven device, the device including a handle, a head base being coupled to the handle, at least one driven shaft extending upwardly into the head base; a motor, the motor being contained substantially within the handle, and transmission, the transmission being constructed to translate rotary motion of the motor to reciprocating motion of the at least one driven shaft; and a plurality of head attachments, each of the plurality of head attachments being releasably engageable, one at a time, with the head base, the plurality of head attachments comprising a first head attachment, a second head attachment, and a third head attachment; wherein the first head attachment is different from the second head attachment, and each of the first head attachment, second head attachment, and third head attachment is selected from the group consisting of a shaver head attachment, a long-hair trimmer head attachment, a body hair trimmer head attachment, a beard trimmer head attachment, a facial hair stubble trimmer head attachment, a skin treatment implement head attachment, and an anti-three-dimensional movement head attachment.

In order to improve ease of manufacture of the electrically-driven device and the plurality of head attachments and the engagement and disengagement of the head attachments to and from the head base, the first head attachment and second head attachment further comprise one or more snap-fit joints and the head base comprises one or more corresponding snap-fit joints constructed to couple to the respective one or more snap-fit joints of the first head attachment and second head attachment.

In order to improve the adaptability, maintain the functional performance of each specific head attachment, and improve the flexibility and convenience for the consumer, the electrically-driven device can include a handle; a head including a head base that is coupled to the handle and movable in at least three dimensions relative to the handle, and a first head attachment and a second head attachment, wherein each one of the first and second head attachments are releasably engageable, one at a time, with the head base, each one of the first and second head attachments includes a skin treatment implement constructed to treat skin or a cutting unit constructed to cut hair, and each of the first head attachment and the second head attachment includes a shaver head attachment, a long-hair trimmer head attachment, a body hair trimmer head attachment, a beard trimmer head attachment, a facial hair stubble trimmer head attachment, or a skin treatment implement head attachment; a stop constructed to be selectively engageable to the head and handle to prevent movement in a third dimension when only one of the first head attachment is engaged to the head base, but not when the second head attachment is engaged to the head base after the first head attachment is disengaged from the head base; a motor, the motor being contained substantially within the handle; and a transmission, the transmission being constructed to translate rotary motion of the motor to linear, reciprocating motion of at least one driven shaft.

In order to more effectively capture and cut hairs, the at least one driven shaft extends into the head and is coupled to and drives the skin treatment implement or cutting unit.

In order to translate rotary motion of a motor disposed at least partially in a handle of the electrically-driven device to linear, reciprocating motion of a skin treatment implement, at one time, and a cutting unit, at another time, an electrically-driven device can include a handle; a head that includes a head base being coupled to the handle and movable in at least two dimensions relative to the handle, and a skin treatment head attachment (200 including brush unit transmission (202, 204) and a brush unit (200) rotatably coupled to the brush unit transmission, a second head attachment including a skin treatment implement (200) constructed to treat skin or a cutting unit (22) constructed to cut hair, wherein each one of the skin treatment head attachment and the second head attachment is releasably engageable, one at a time, with the head base; a motor (30), the motor being contained at least partially within the handle; a first transmission (32) coupled to the motor; a first driven shaft (46) coupled to the first transmission, opposite the motor; and a second driven shaft (48) coupled to the first transmission, opposite the motor; wherein the first transmission being constructed to translate rotary motion of the motor to linear, reciprocating motion of the first driven shaft and to the second driven shafts; wherein, when the skin treatment head attachment is releasably engaged to the head base, the brush unit transmission is coupled to one of the first or second driven shafts and translates the linear, reciprocating motion of the coupled first or second driven shaft to rotary motion, rotating the skin implement.

Referring to FIGS. 1-5, an electrically-driven device 10 is shown. As shown in FIG. 1, the electrically-driven device 10 may include a handle 12 and a head 16 coupled to the handle. The electrically-driven device 10 may have a longitudinal axis $A_1$. Although the head 16 in FIGS. 1-5 is shown to have a substantially cuboid shape, a head may have any of a variety of other suitable shapes and configurations. In certain embodiments, a user can grip the handle 12 and direct the head 16 or, at least a portion of the head, to engage skin or hair of the user's face, neck, or other areas of the user's body in order to treat the skin and/or shave or trim hair therefrom. To enhance various aspects of a grooming experience, in certain embodiments, the head 16 can be a relatively lightweight head.

Figure 11:
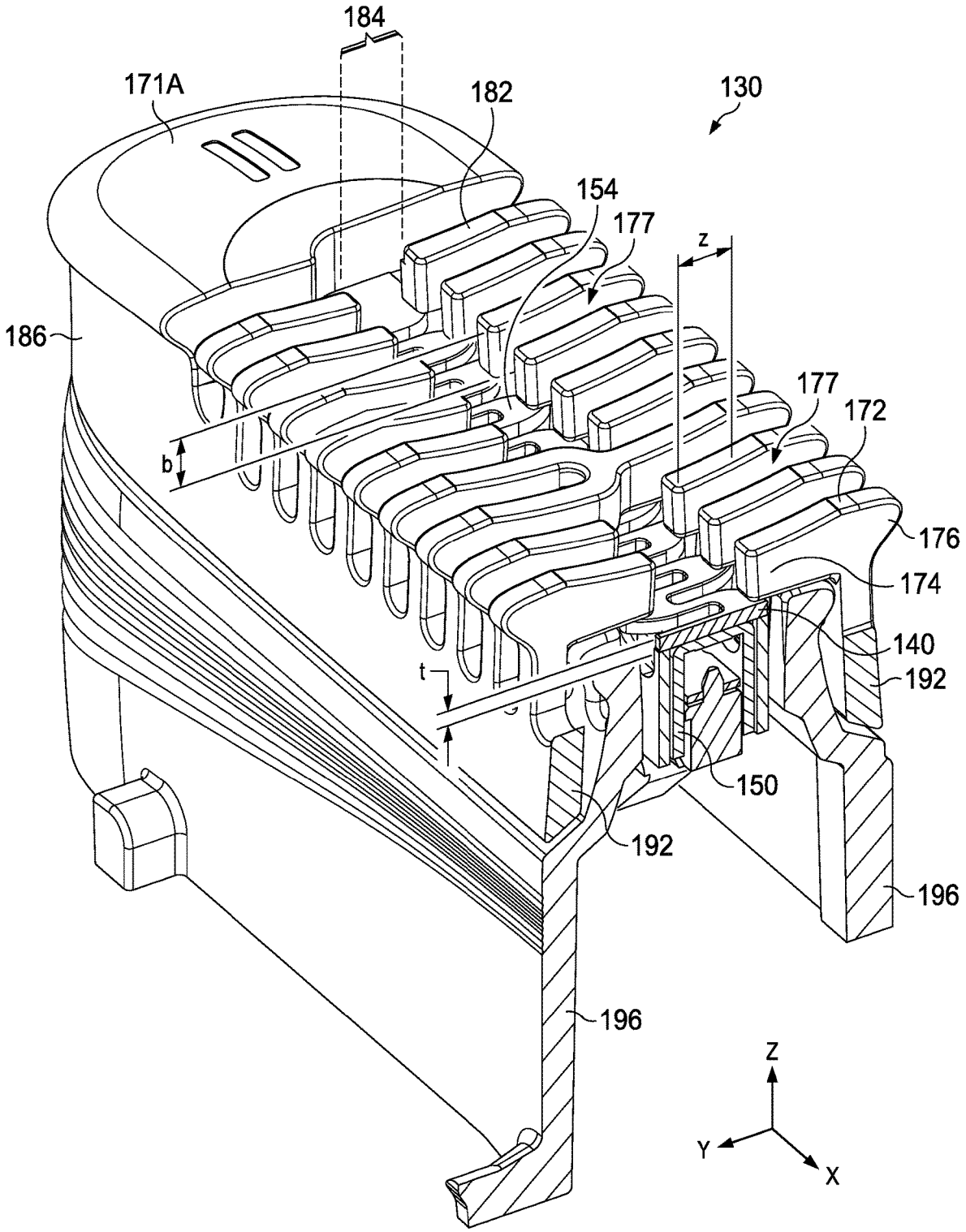
FIG. 11 depicts a cross sectional view of the cutting unit of FIG. 10.
Figure 12:
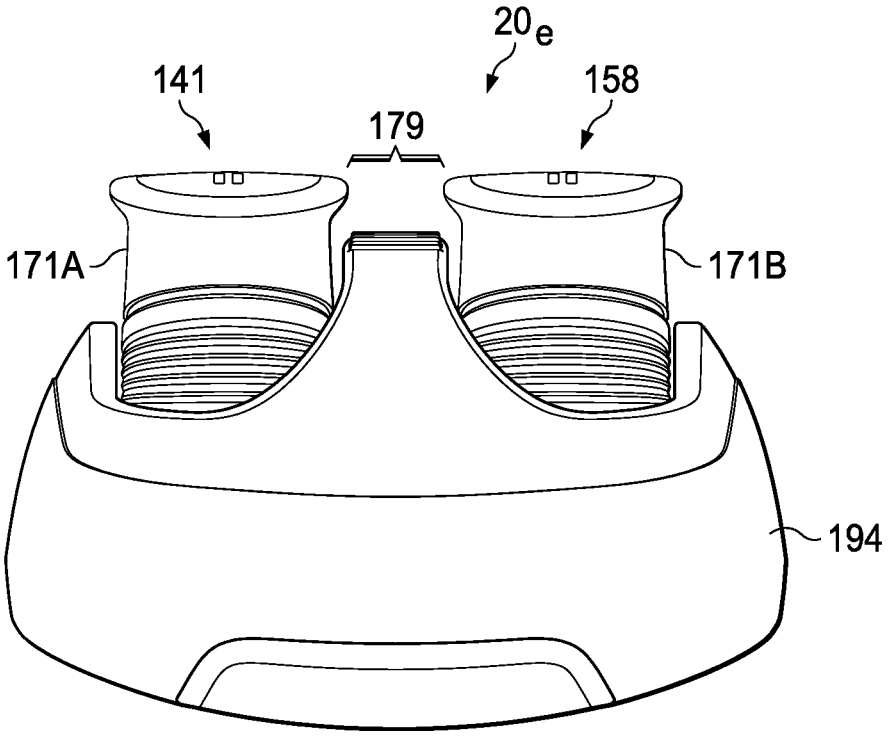
FIG. 12 depicts an end view of the facial hair stubble trimmer head attachment of FIG. 10.

In certain embodiments, the head 16 can include a head base 18 that is coupled to one end of the handle 12 and a head attachment (generally shown in FIG. 1 as 20) that releasably engages the head base 18. In certain embodiments, the head base 18 can include a housing 17. The housing 17 can include one or more components that when coupled to each other form the housing 17. In certain embodiments, the head attachment 20 may comprise any one of a plurality of head attachments. Examples of the plurality of head attachments may include the following: a shaver head attachment 20*a* shown in FIGS. 1-5; a long hair trimmer head attachment 20*b* shown in FIGS. 6 and 8; a body hair trimmer head attachment 20*c* shown in FIGS. 7 and 9; a beard trimmer head attachment also shown in FIGS. 7 and 9 because it is structurally the same as the body hair trimmer 20*c*; a facial hair stubble trimmer head attachment 20*e* as shown in FIGS. 11-12; skin treatment head attachment 20*f* shown in FIG. 13, or anti-three-dimensional movement head attachment 20*g* shown in FIGS. 14 and 15. In certain embodiments, the head attachment may include a housing 25. The housing 25 can include one or more components that when coupled to each other form the housing 25, which can encompass some or all of the components comprising the head attachment. The head base 18 can be constructed to releasably receive and engage, one at a time, any one of the plurality of head attachments (20*a*, 20*b*, 20*c*, 20*d*, 20*e*, 20*f*, or 20*g*) set forth herein. Specifically, in FIGS. 1-5, the head attachment 20 is shown as a shaver head attachment 20*a* releasably engaged to the head base 18.

A shaver (e.g., shaver head attachment 20*a* engaged to the electrically-driven device 10), as defined herein, may include one or more cutting units constructed to shave body hair and/or facial hair that has a very short length to a length that is at or substantially at or below the skin's surface, thus providing a "clean shaven" appearance. See, for example, further description below with reference to the figures herein.

A long hair trimmer (e.g., long hair trimmer attachment 20*b* engaged to the electrically-driven device 10), as defined herein, may include one or more cutting units constructed to cut and/or maintain hair that has a longer length than hair such as, "whiskers". A long hair trimmer, as defined herein, will not be used with distance combs and can be angled or straight in orientation. Typically, a long hair trimmer is used for removing visible hair from an area. See, for example, further description below with reference to the figures herein.

A body hair trimmer (e.g., beard trimmer attachment 20*c* engaged to the electrically-driven device 10), as defined herein, may include one or more cutting units constructed to cut hair that has a longer length and such that it will leave some hair remaining when the trimming function is completed. The body hair trimmer can be configured to work more easily with the skin such as, for example, that the head may follow the contours of the body. The body hair trimmer can be configured to include finer pitch, finer teeth than that found in a body hair trimmer. In certain embodiments, a body trimmer can include two long hair cutters on opposing sides so that the trimmer can be moved over the body and used in both directions (no specific angel of inclination of the blade). Also, distance combs are not used with the body hair trimmer to perform body hair trimming. See, for example, further description below with reference to the figures herein.

A beard trimmer (e.g., beard trimmer attachment 20*d* engaged to the electrically-driven device 10), as defined herein, may include one or more cutting units constructed to cut hair that has a longer length and such that it will leave some hair remaining with the trimming function is completed. The beard trimmer is relatively more powerful than a shaver and/or one or more of the other types of hair grooming or skin treatment attachments. As described above, the beard trimmer may be constructed similar to the body hair trimmer and perform similar functions. See, for example, further description below with reference to the figures herein. However, in certain embodiments, the beard trimmer can include one or more cutters where the blade(s) are angled on one side for accurate beard contour or longer beard length.

A facial hair stubble trimmer (e.g., Facial hair stubble trimmer head attachment 20*e* engaged to the electrically-driven device 10), as defined herein, may include one or more cutting units constructed to cut hair to one or more specific lengths to provide an appearance of facial hair of a one or more days of facial hair growth. See, for example, further description below with reference to the figures herein. In certain embodiments, the facial hair stubble trimmer can include one or more long hair cutters disposed with a normally short hair cutter in order to pre-cut longer hairs. In certain embodiments, only such long hair cutters are used in combination with micro comb teeth distances which allows accurate stubbing of shorter long hairs in the range of 0 to 5 day beard, with blades (cutters) for used on both sides.

Figure 2:
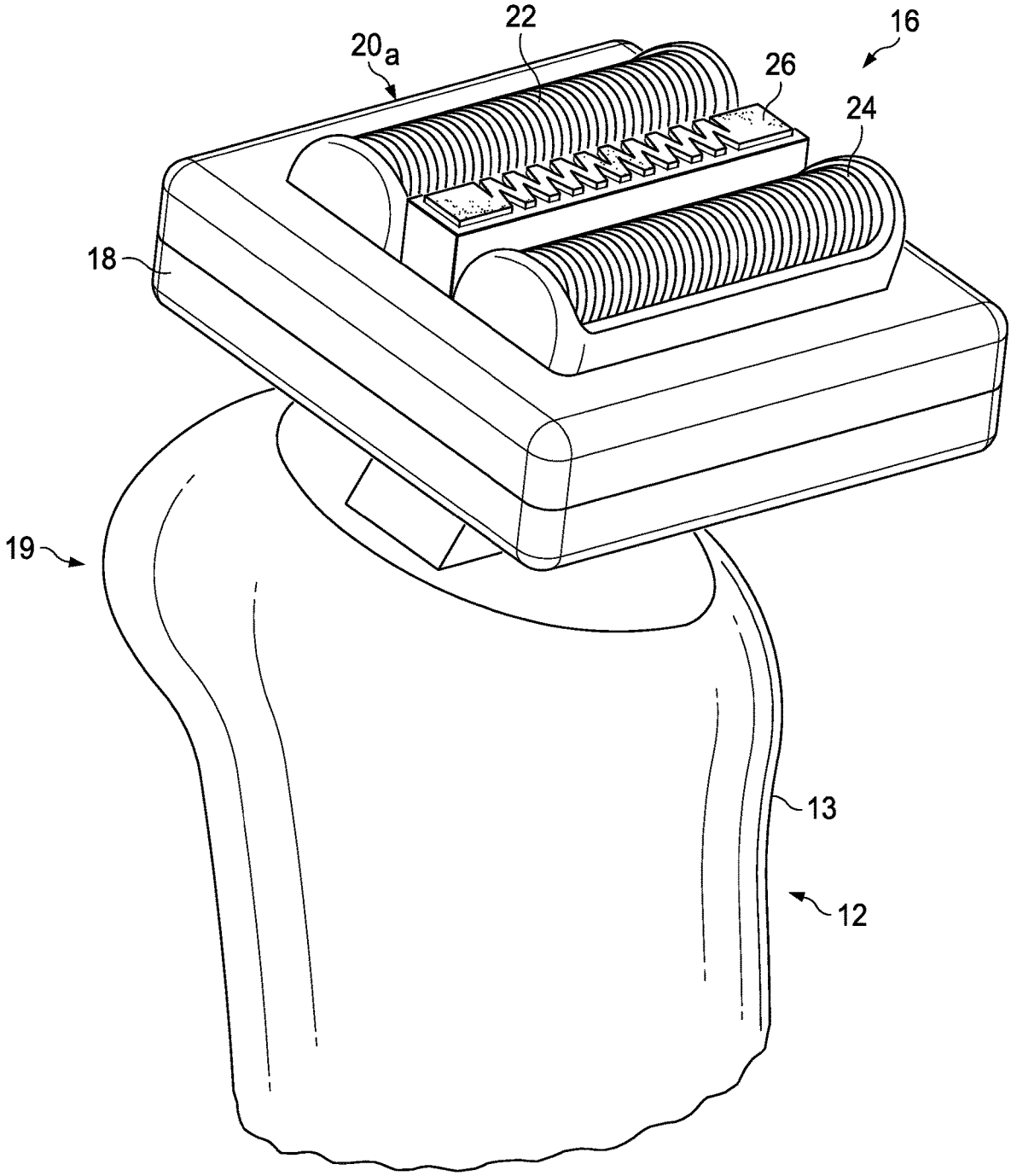
FIG. 2 depicts an isometric view of a top portion of the electrically-driven razor of FIG. 1.

The handle 12 can have a cylindrical shape or any other suitable shape or configuration. In certain embodiments, the handle 12 can be shaped to provide a user with one or more ergonomic gripping surfaces. In certain embodiments, the handle 12 can include a finger rest 19 as shown in FIG. 2. In certain embodiments, the finger rest 19 can be a projection from a top, rear portion of the handle 12 such that the finger rest 19 can be configured to engage, for example, the user's index finger. It will be appreciated that, in other embodiments, an electrically-driven device can include one or more finger rests of any of a variety of suitable positions, sizes and shapes or the electrically-driven device can be provided without a finger rest.

Figure 3:
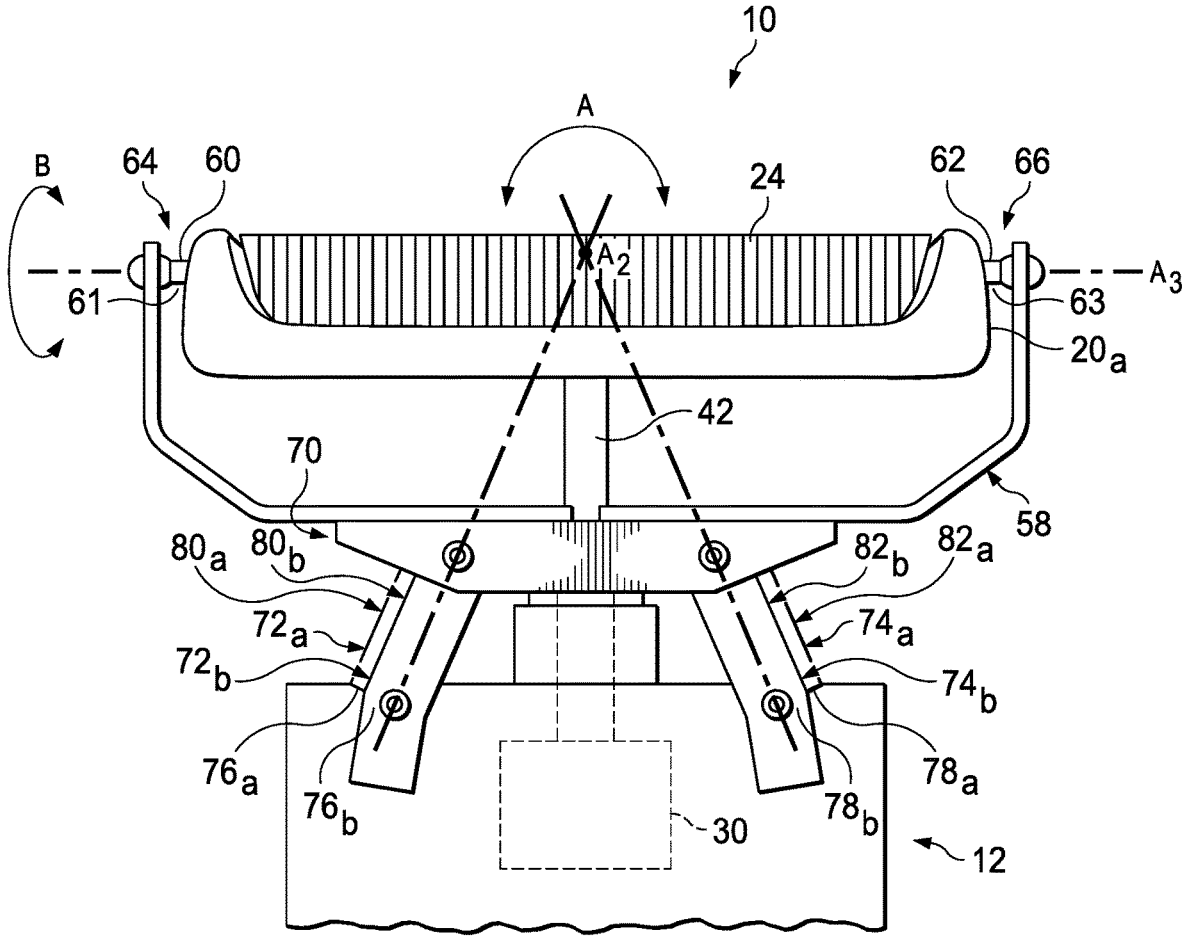
FIG. 3 depicts a schematic view of a first support member and a four-link mechanism of the electrically-driven razor of FIG. 1

The head 16 may be coupled to the handle such that it is coaxially aligned with the handle's longitudinal axis $A_1$ or at an angle relative to the longitudinal axis of the handle. The head 16 can be coupled to the handle 12 such that the head 16, or a portion of the head 16, is fixed in a position relative to the handle 12 or such that the head 16, or a portion of the head 16, may tilt and/or swivel in one or more directions relative to the handle 12 (macro movements of the head). Referring to FIGS. 1 and 3, in certain embodiments, the head 16, including the head base 18 and shaver head attachment 20*a*, may tilt about a first transverse axis $A_2$ as indicated by arrow (A), thus providing movement of the head in at least two-dimensions (2D) (macro movement).

FIG. 3 illustrates one example of mechanisms by which such tilting movement can be realized. The handle 12 can include a four-link support mechanism 70. The housing 25 of shaver head attachment 20*a* and the head base 18, including its housing 17, have been removed for illustration purposes only in order to provide an improve view of the four-link mechanism 70 and other components that may generally be hidden from view during normal use. As depicted in FIG. 3, the four-link support mechanism 70 can include a first arm 72*a*, a second arm 72*b*, a third arm 74*a*, and a fourth arm 74*b*. In certain embodiments, each of the first and second arms 72*a* and 72*b*, respectively, and the third and fourth arms 74*a* and 74*b*, respectively, can include respective lower portions 76*a*, 76*b*, 78*a*, and 78*b* and respective upper portions 80*a*, 80*b*, 82*a*, and 82*b*. The respective lower portions 76*a*, 76*b*, 78*a*, and 78*b* of each of the first, second, third, and fourth arms 72*a*, 72*b*, 74*a*, and 74*b* can be rotatably coupled to the handle 12, a portion of which is depicted in the schematic diagram of FIG. 3.

The respective upper portions 80*a*, 80*b*, 82*a*, and 82*b* of each of the first, second, third, and fourth arms 72*a*, 72*b*, 74*a*, and 74*b* can be rotatably coupled to a first support member 58. In certain embodiments, the four-link support mechanism 70 can allow for tilting movement about the first transverse axis $A_2$ of the head base 18 and one of the plurality of head attachments (e.g., shaver head attachment 20*a*), relative to the handle 12. In FIG. 3, the head base 18 has been removed for illustration purposes only in order to more easily view the four-link support mechanism 70. It is understood that other mechanisms may be included to enable such tilting movement and/or other degrees of freedom. As one example, first and second arms 72*a* and 72*b* may be combined into a single linkage rather than two separate linkages, and the third and fourth arms 74*a* and 74*b* may be combined into a single linkage rather than two separate linkages.

As shown in FIGS. 1 and 3, in certain embodiments, the head 16 may swivel about a second transverse axis $A_3$ as indicated by arrow (B) 1 as will be shown and described below herein, thus providing movement of the head in at least two-dimensions (2D) (macro movement). In certain embodiments, the head 16 may tilt about the first transvers axis $A_2$ as described above and swivel about the second transverse axis $A_3$ as described above, thus the tilt and swivel movement provides movement of the head in at least three-dimensions (3D).

Specifically, as shown in FIG. 3, the first support member 58 can include a first tab 60 and a second tab 62 disposed opposite the first tab. In certain embodiments, the first support member 58 can extend along substantially a length of the head 16, where the first tab 60 can be rotatably coupled to a first end 64 of the head base 18 and the second tab 62 can be rotatably coupled to a second end 66, opposite the first end, of the head base 18, only a portion of which is shown in FIG. 3 in order to best view the first support member 58. In such embodiments, the first tab 60 inserts into a first aperture 61 disposed at the first end 64 of the head base 18 and the second tab 62 inserts into a second aperture 63 disposed at the second end 66 of the head base 18. The first tab 60 and second tab 62 swivelably connects the head base 18 to the first support member 58, enabling the head base 18 (and the shaver head attachment 20*a* that is engaged to the head base) to swivel about the second transverse axis $A_3$ defined between the first and second tabs 60 and 62, respectively. Other conventional engagement mechanisms may also be used to swivelably connect the head base 18 to the first support member 58.

Figure 4:
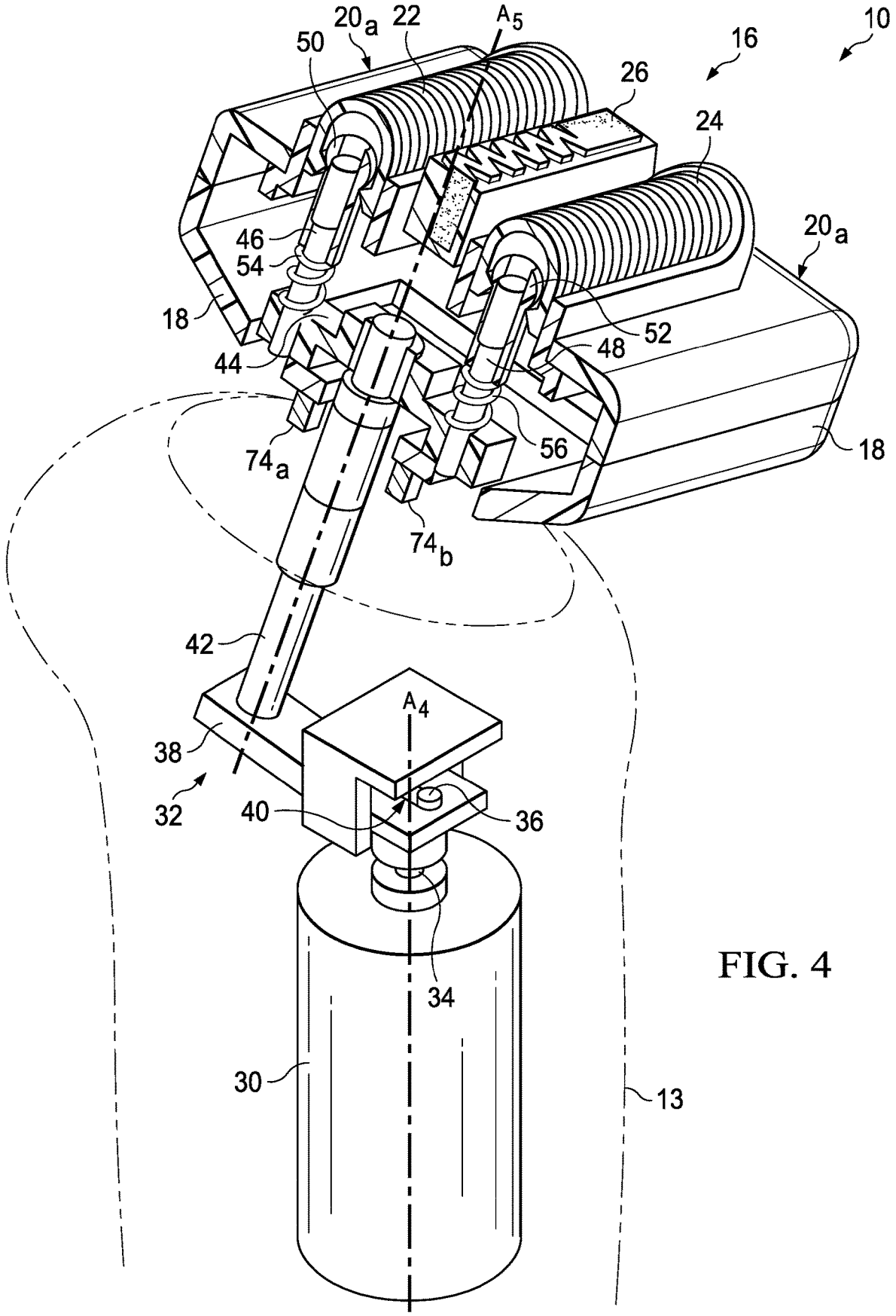
FIG. 4 depicts a cross-sectional view of a head, including a head base and a shaver head attachment releasably engaged with the head base, and a schematic view of the motor and transmission coupled to the head of the electrically-driven device of FIG. 1.

Referring specifically to FIGS. 3 and 4, the electrically-driven device 10 can further include a motor 30. In certain embodiments, the motor 30 can be contained substantially within the housing 13. Without wishing to be bound by theory, it is believed that by substantially minimizing the weight of the moving parts included in the electrically-driven device 10 compared to the overall weight of the electrically-driven device may reduce vibrations in the handle 12. In certain embodiments, the motor 30 can be a DC motor; and in other embodiments, the motor 30 can be a linear drive motor. It will be appreciated, however, that any of a variety of suitable motors may be used in an electrically-driven device.

The electrically-driven device 10 can further include a transmission 32. The transmission 32 can be constructed to translate rotary motion of the motor 30 to reciprocating motion of at least one driven shaft. As shown in FIG. 4, the motor 30 can include a drive shaft 34. The drive shaft can define a drive shaft longitudinal axis $A_4$. The drive shaft 34 can be coupled to a drive pin 36, which can be arranged eccentrically with respect to the drive shaft 34. In certain embodiments, the drive shaft 34 can be directly coupled to the drive pin 36; and in other embodiments, a gearing can be positioned there between. The transmission 32 can further include one or more crank arms. As depicted in FIG. 4, a crank arm 38 can include at one end a slotted hole 40, which can be configured to receive the drive pin 36, and at another end, the crank arm 38 can be coupled to an intermediate shaft 42, which, in certain embodiments, can be rotationally constrained with respect to the crank arm 38. The intermediate shaft 42 can define an intermediate shaft longitudinal axis $A_5$, which can be inclined with respect to the drive shaft longitudinal axis $A_4$, as shown in FIG. 4. In such embodiments, the motor 30 can be activated to cause rotation of the drive shaft 34 about the drive shaft longitudinal axis $A_4$. The rotation of the drive shaft 34 can cause the drive pin 36 to rotate eccentrically with respect to the drive shaft 34. The eccentric rotation of the drive pin 36 within the slotted hole 40 can cause the drive pin 36 to engage the crank arm 38 within the slotted hole 40, thereby resulting in reciprocating pivoting movement of the crank arm 38, which can rotate the intermediate shaft 42 about the intermediate shaft longitudinal axis $A_5$.

The intermediate shaft 42 can be coupled to a bridge 44. In certain embodiments, the bridge 44 can be rotationally constrained with respect to the intermediate shaft 42. Thus, in such embodiments, the reciprocating pivoting movement of the crank arm 38 can be transmitted through the rotation of the intermediate shaft 42 to reciprocating pivoting movement of the bridge 44. The electrically-driven device 10 can further include at least one driven shaft, and as depicted in FIG. 4, the at least one driven shaft can be a first driven shaft 46 and a second driven shaft 48, both of which can be coupled to the bridge 44. In such embodiments, the first driven shaft 46 and the second driven shaft 48 can be rotationally and axially constrained to the bridge 44 such that the reciprocating pivoting movement of the bridge 4 causes the first driven shaft 46 and the second driven shaft 48 reciprocating motion in opposite directions from each other. In certain embodiments, each of the first driven shaft 46 and the second driven shaft 48 can be offset with respect to the intermediate shaft longitudinal axis $A_5$, as defined by the intermediate shaft 42, but substantially parallel thereto.

Figure 13:
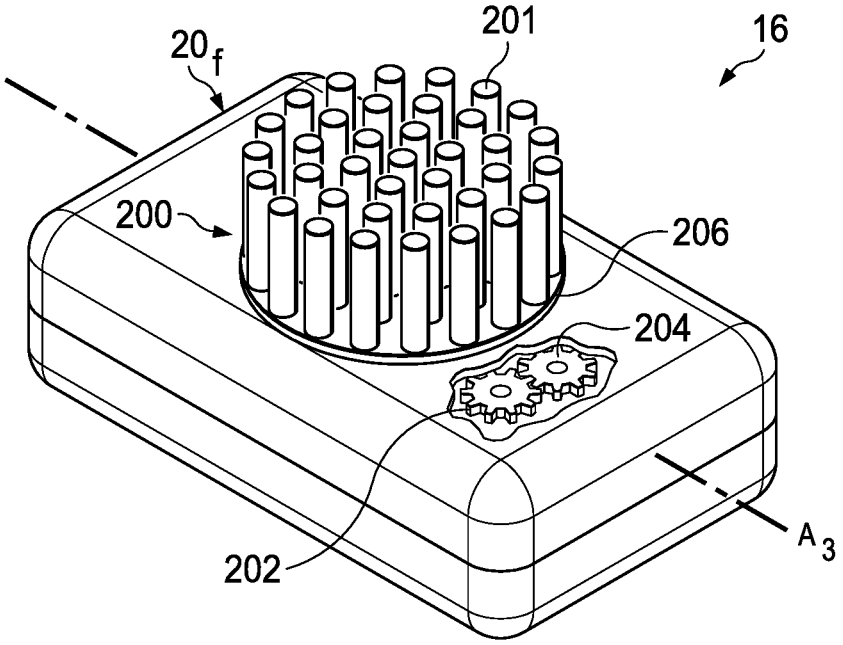
FIG. 13 depicts an isometric view of skin treatment head attachment, according to one or more embodiments.

In certain embodiments, each of the first driven shaft 46 and the second driven shaft 48 can extend from the bridge 44 into the head base 18 and/or into the head attachment (e.g., 20*a*, 20*b*, 20*c*, 20*d*, 20*e*, 20*f*, or 20*g*). In certain embodiments, one or more of the first driven shaft 46 and second driven shaft 48 can be coupled to one or more cutting units (e.g., a first blade-type inner cutting unit 22, a second blade-type inner cutting unit 24, a center cutting unit 26, etc., as shown in FIGS. 1-5 and described below herein), skin treatment implements (e.g., brush 200 as shown in FIG. 13, or other types of cutter blades such as those shown in FIGS. 6-12 and described below herein) in order to drive such cutting units and/or skin treatment implements of one of the plurality of head attachment (e.g., 20*a*, 20*b*, 20*c*, 20*d*, 20*e*, 20*f*, or 20*g*) that is releasably engaged with the head base 18.

Still referring to FIGS. 1-5, the shaver head attachment 20*a* may include conventional cutting units included in shavers such as, for example, a first foil-type cutting unit, a second foil-type cutting unit spaced apart from the first foil-type cutting unit, both constructed to cut short hairs. The shaver head attachment 20*a* can also include a third cutting unit positioned between the first and second cutting units, which can be constructed to cut long hairs. Generally, each of the foil-type cutting units can include a blade-type under cutter 22 and 24, respectively, and a foil-type upper cutter disposed over each of the respective blade-type under cutter 22 and 24. As shown in FIGS. 1-5 and for illustration purposes only, the foil-type upper cutters have been removed in order to show the blade-type under cutters 22 and 24. Generally, the blade-type under cutters 22 and 24 are driven by one or more drive units.

The first foil-type cutting unit and the second foil-type cutting unit can be constructed to provide the cutting units the ability to float or to slightly tilt relative to the head attachment itself (micro movements) as known in the art. Such floating or slightly tilting of the cutting units can be provided one or more springs biasing the cutting units toward the skin. The facial hair stubble trimmer head attachment 20*e* shown in FIGS. 10-12 and described below herein also are constructed to permit these micro movements, i.e., floating and/or slight tilting, relative to the head attachment itself. These micro movements relative to the head attachments are much smaller than the macro movements relative to the handle as described herein. It is appreciated that in certain embodiments, the skin treatment implements and/or the cutting units can be constructed to include and permit these micro movements and/or the macro movements as set forth herein.

As depicted, for example, in FIG. 4, the first driven shaft 46 and the second driven shaft 48 can be coupled to the first foil-type cutting unit 22 and the second blade-type inner cutting unit 24, respectively, of the shaver head attachment 20*a*. In certain embodiments, the first driven shaft 46 can be coupled to the first blade-type inner cutting unit 22 via a first bearing sleeve 50, and the second driven shaft 48 can be coupled to the second blade-type inner cutting unit 24 via a second bearing sleeve 52. In such embodiments, the first bearing sleeve 50 and the second bearing sleeve 52 can be rotatable and axially displaceable with respect to the first driven shaft 46 and the second driven shaft 48, respectively. As shown in FIG. 4, the first bearing sleeve 50 and the second bearing sleeve 52 can be biased by a first spring 54 and a second spring 56, respectively. Such an arrangement can allow the reciprocating motion of the first driven shaft 46 and the second driven shaft 48 to be transferred to the first blade-type inner cutting unit 22 and the second blade-type inner cutting unit 24, respectively.

In certain embodiments, the transmission 32 can be substantially, or at least partially, contained within the housing 13, the head base 18, and/or the head attachment. And in some embodiments, the transmission 32 can allow for a relatively reduced number of parts compared to other, conventional electrically-driven devices, thereby requiring fewer parts to be positioned, for example, within the head 16. As such, to maintain a lightweight head, in certain embodiments, the electrically-driven device 10 can include a head 16 where neither the motor 30 nor the transmission 32 are contained therein. Such a beneficial configuration of the transmission 32 can further serve to emphasize the separation of the head 16 and the handle 12 and/or facilitation of macro-movement of the head 16, relative to the handle 12, as previously described herein with respect to a relatively narrow coupling. Without wishing to be bound by theory, it is believed that by providing a lightweight head and a relatively narrow coupling, the head base 18 and/or the head attachment (e.g., 20*a*, 20*b*, 20*c*, 20*d*, 20*e*, 20*f*, or 20*g*) can exhibit a lower inertia, more easily adapt to skin contour, and experience improved flexing at various neck and facial positions.

Figure 5:
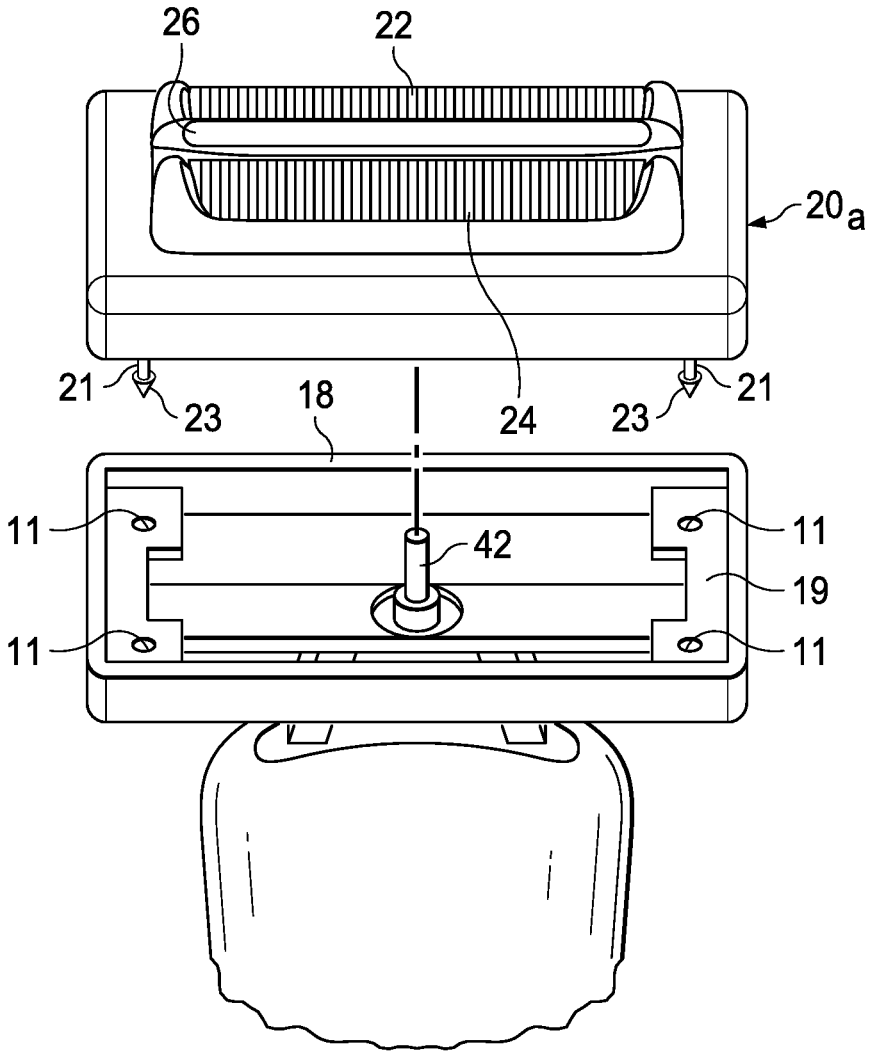
FIG. 5 depicts a schematic view of the electrically-driven device in FIG. 1, with a head attachment disengaged from a head base.

The head attachments 20*a*-20*g* may be releasably engaged with the head base 18 using any number of conventional connection mechanisms such as, for example, snap-fit joints and/or connector as known in the art, flanged-end protrusions received within and engaged by a spring-biased pins or connectors as known in the art, other conventional releasably engageable connectors, or combinations thereof. Referring to FIG. 5, the shaver head attachment 20*a* can be releasably engaged with the head base 18 and/or then disengaged from the head base 18. This releasable engagement and disengagement of any one of the head attachments 20*a*-20*g* to the head base 18 may be accomplished by the snap-fit joints shown, for example, in FIG. 5. For example, the shaver head attachment 20*a* can includes one or more legs 21 extending from the head attachment 20*a*. Each leg 21 can include a flanged end 23 disposed at a distal end of the leg 21. In certain embodiments, the flange ends 23 may be fabricated from deformable material. Also, the head base 18 can include one or more apertures 11 that are constructed to receive the one or more legs 21 of the shaver head attachment 20*a*. As shown, the flanged end 23 of each one of the one or more legs 21 is constructed to have a diameter that is larger than the diameter of the one or more apertures 11. When the shaver head attachment 20*a* is brought together with the head base 18, the one or more legs 21 insert into a respective aperture of the one or more apertures 11 such that flange ends 23 of each of the one or more legs 21 inserts into the one or more apertures 11 (causing each flanged end 23 to deform such that the diameter of each flanged end 23 is temporarily be reduced) until each flanged end 23 inserts completely through the respective aperture 11 such that each flanged end 23 resumes its natural form and thus its normal diameter. As such, the shaver head attachment 20*a* is releasably engaged to the head base 18.

Other conventional snap-fit joints or connectors that enable the shaver head attachment 20*a* to be releasably engaged to the head base 18 may be used. For example, the one or more legs 21 may each include a flanged end (not shown) that flares or cams outwardly from only one side of the leg 21. The flanged end is constructed such that when the flanged end is inserted into a respective aperture 11, the cam surface of each leg engages the perimeter of the aperture 11, causing the leg 21 to bend sufficient enough to permit the flanged end to insert completely through the aperture 11, releasably engaging the shaver head attachment 20*a* to the head base 18. In certain embodiments, one or more of the legs 21 may include a detent disposed therein, rather than the flanged end. In such embodiments, the head base 18 may include the one or more apertures 11 and one or more spring-biasing members that are biased toward the one or more apertures 11 such that when the one or more legs 21 are inserted into the respective one or more apertures 11 the spring-biasing member engages the one or more detents. To remove the shaver head attachment 20*a* from the head base 18, the removal force must be enough to overcome the spring force, causing the spring-biasing member to disengage from the detents.

Although the embodiment described above and shown in FIGS. 1-5 is shown with the shaver head attachment 20*a* releasably engaged with the head base 18, any one of the plurality of head attachments (e.g., a long hair trimmer head attachment 20*b* shown in FIGS. 6 and 8; a body hair trimmer head attachment 20*c* shown in FIGS. 7 and 9; a beard trimmer head attachment also shown in FIGS. 7 and 9 because it is structurally the same as the body hair trimmer 20*c*; a facial hair stubble trimmer head attachment 20*e* as shown in FIGS. 11-12; skin treatment head attachment 20*f* shown in FIG. 13, or anti-three-dimensional movement head attachment 20*g* shown in FIGS. 14 and 15) may be releasably engaged with the head base 18 instead of the shaver head attachment 20*a*.

Any of the other head attachments (20*a*, 20*b*, 20*c*, 20*d*, 20*e*, 20*f*, or 20*g*) may include any of the releasable engagement mechanisms, including the "snap-fit" and spring-biasing engagement mechanisms, as shown and described above with reference to shaver head attachment 20*a* to releasably engage with the head base 18.

Figure 6:
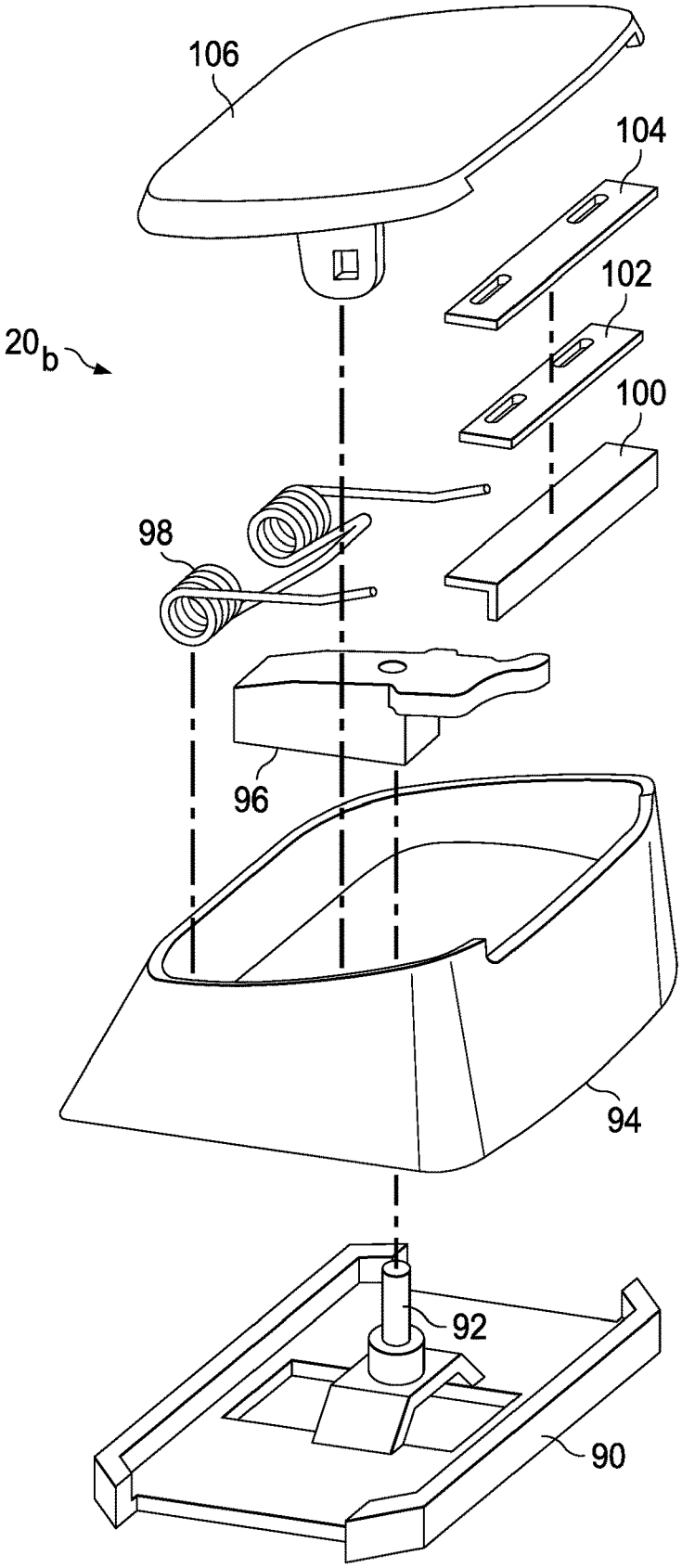
FIG. 6 depicts a telescopic view of a long hair trimmer head attachment, according to one or more embodiments.
Figure 8:
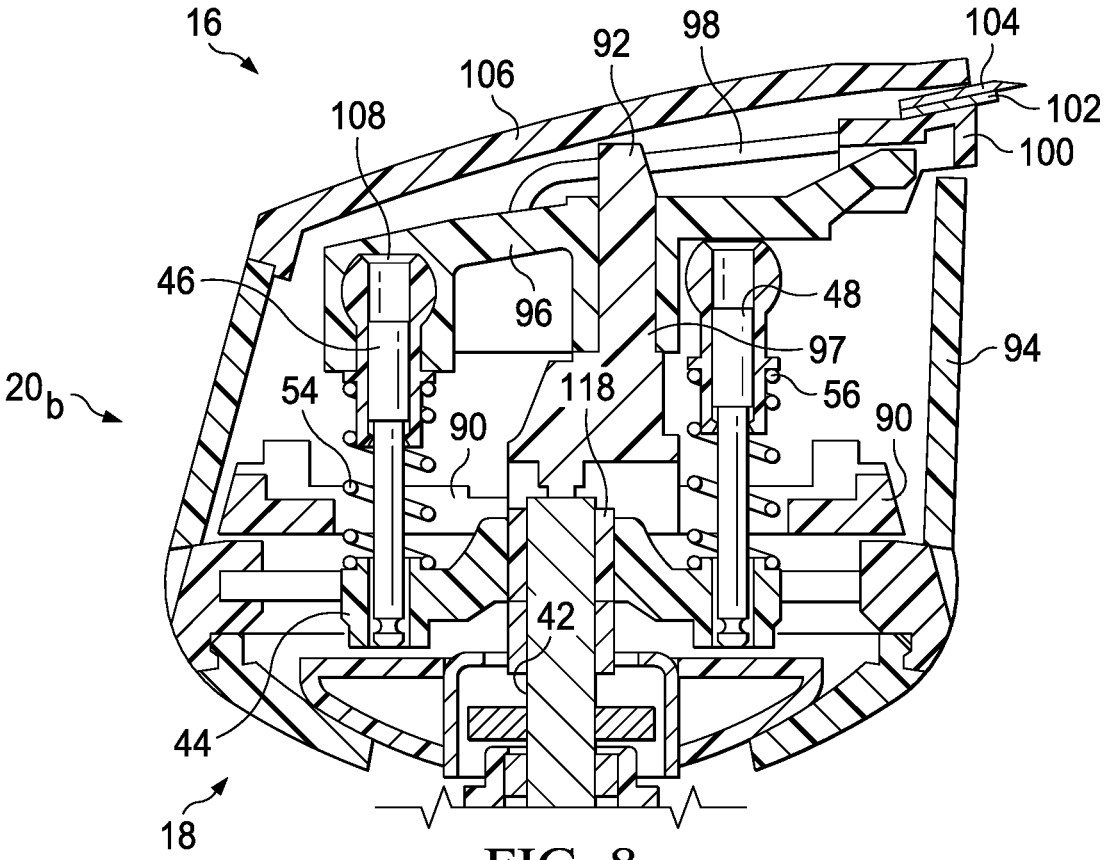
FIG. 8 depicts a cross sectional view of the long hair trimmer head attachment of FIG. 6.

Referring to FIGS. 6 and 8, the long hair trimmer head attachment 20*b* is shown. The long hair trimmer head attachment 20*b* can include a lower frame 90, a post 92 extending from the lower frame 90, a rocking arm 96, a fixed blade 104, a cutter blade 102 that can move relative to the fixed blade 104, a spring 98 that biases the cutter blade 102 against the fixed blade 104 (i.e., applies cutting pressure to the fixed blade), a movable carrier 100 that is fixed to the cutter blade at one end and the rocking arm 96 at the opposite end, a hood 94 that encompasses a portion of or all of these components, and a cover 106 that connects to a top portion of the hood. The rocking arm 96 includes a post opening 97 to receive the post 92 of the lower frame 90 and a first bearing sleeve 108 constructed to receive the first driven shaft 48.

As shown in FIG. 8, when the long hair trimmer head attachment 20*b* is engaged with the head base 18, the first driven shaft 46 inserts into the first bearing sleeve 108 of the rocking arm 96 at an end opposite the rocking arm's engagement with the carrier 100. The second driven shaft 48 inserts into the head attachment 20*b*, but does not engage the rocking arm 96. Thus, when the first driven shaft 46 reciprocates back and forth, it causes the rocking arm 96 to reciprocate and pivot back and forth about the post 92, causing the carrier 100 to reciprocate (linearly or pivotally) back and forth and thus causing the cutter blade 102 to do the same. The cutter blade is driven with a ratio that is something different than 1:1. In certain embodiments, the ratio can be, for example, 1, 15:1.

Figure 7:
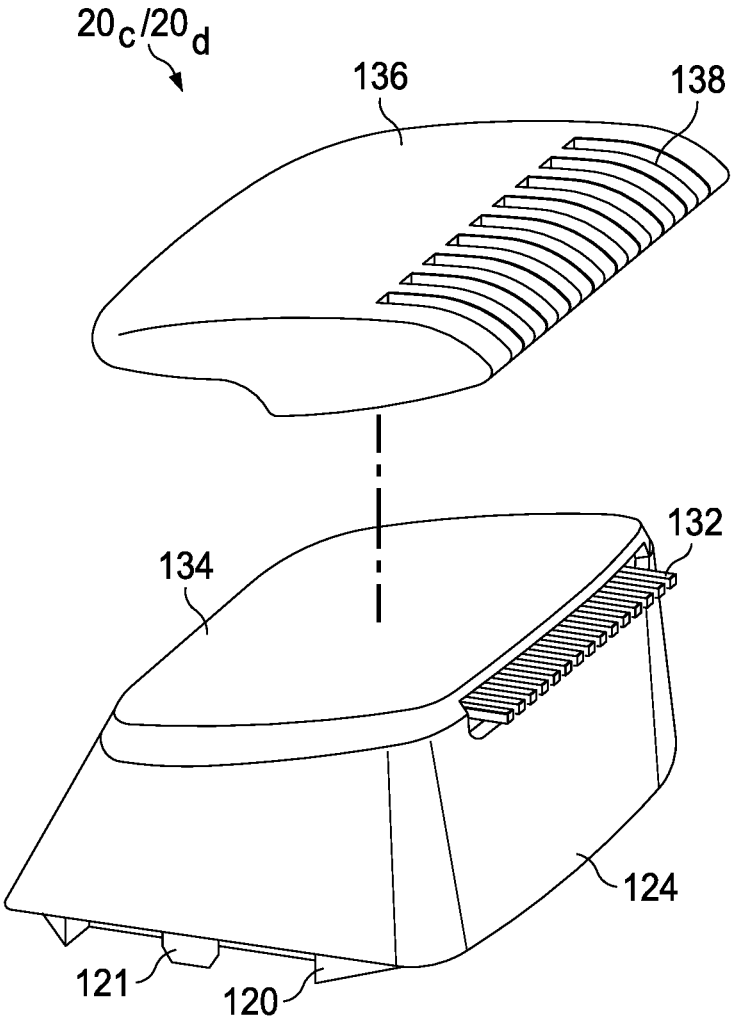
FIG. 7 depicts a isometric view of a body hair or beard trimmer head attachment, according to one or more embodiments.
Figure 9:
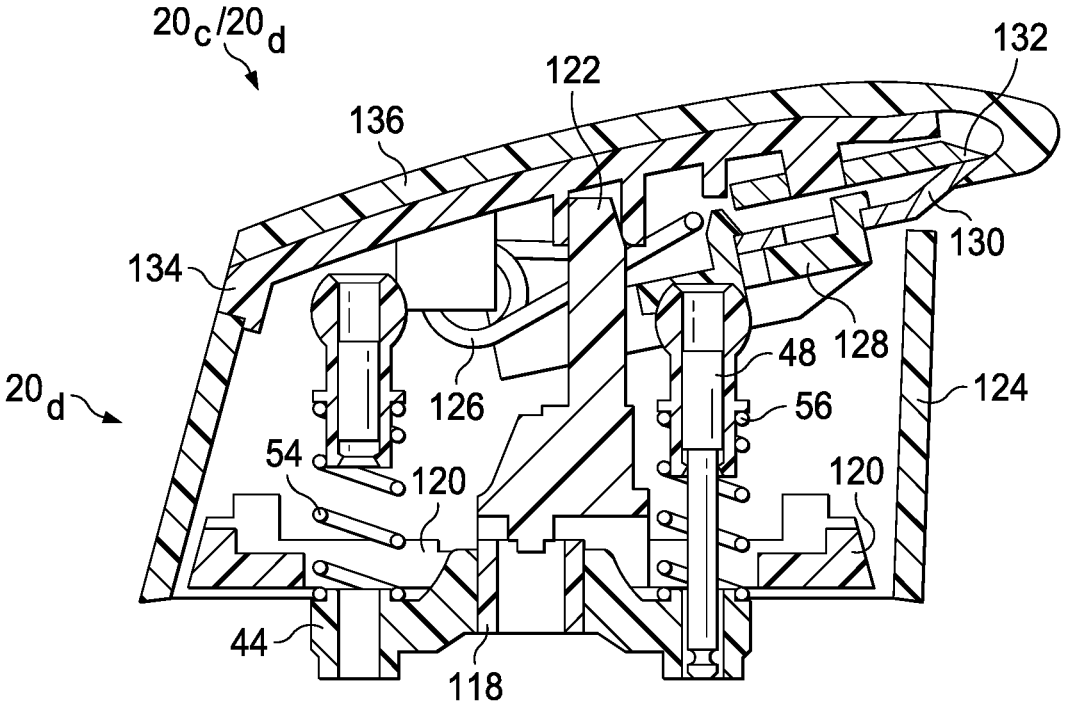
FIG. 9 depicts a cross sectional view of the body hair or beard trimmer head attachment of FIG. 7.

Referring now to FIGS. 7 and 9, the body hair trimmer head attachment (20*c*) and the beard trimmer head attachment 20*d* are shown. FIGS. 7 and 9 are shared for both the body hair trimmer head attachment 20*c* and beard trimmer head attachment 20*d* because these two head attachment can include all or most of the same components and thus function and operate the same or substantially similar to each other. The body hair trimmer head attachment (20*c*) can include a lower frame 120, a post 122 extending from the lower frame 120, a fixed blade 132, a cutter blade 130 that can move relative to the fixed blade 132, a spring 126 that biases the cutter blade 130 against the fixed blade 132 (i.e., applies cutting pressure to the fixed blade), a movable carrier 128 that is fixed to the cutter blade, a hood 124 that encompasses a portion of or all of these components, and a cover 134 that connects to a top portion of the hood.

As shown in FIG. 9, when the body hair trimmer head attachment 20*c* is engaged with the head base 18, the first driven shaft 46 inserts into the head attachment, but does not engage anything, and the second driven shaft 48 inserts into the head attachment 20*c* and engages the carrier 128. Thus, when the second driven shaft 48 reciprocates back and forth, it causes the carrier to reciprocate, pivot, or slide back and forth, driving the cutter blade 130 with a ratio of something different than 1:1. In certain embodiments, the ratio can be, for example, 1, 15:1.

The body hair trimmer head attachment may also include a releasably engageable comb as conventionally known that can engage the cover and/or the hood. A plurality of combs (e.g., comb 136) may be available to releasably engage the body hair trimmer head attachment, one at a time. Each comb may include a plurality of teeth 138 and provide a guard to limit a different length of hair trimmed from the body, thus providing multiple options for hair-trim length. In certain embodiments, the body hair trimmer head attachment can include a different cutting blade than included in the long hair trimmer head attachment 20*b*; it can be a finer blade. The body hair trimmer head attachment can be configured to work more easily with the skin such as, for example, that the head may follow the contours of the body. The body hair trimmer head attachment 'can be configured to include a finer pitch and finer teeth. In certain embodiments, a body hair trimmer head attachment' can include two long hair cutters on opposing sides so that the trimmer can be moved over the body and used in both directions (no specific angel of inclination of the blade). Also, distance combs are not used with the body hair trimmer head attachment to perform body hair trimming. It is appreciated that although distance comb 136 is shown releasably engageable with the body hair trimmer head attachment 20*d*, the comb 136 can be releasably engageable with and thus used with any of the other head attachments disclosed herein.

The beard trimmer head attachment 20*d* can include a lower frame 120, a post 122 extending from the lower frame 120, a fixed blade 132, a cutter blade 130 that can move relative to the fixed blade 132, a spring 158 that biases the cutter blade 130 against the fixed blade 132 (i.e., applies cutting pressure to the fixed blade), a movable carrier 128 that is fixed to the cutter blade, a hood 124 that encompasses a portion of or all of these components, and a cover 134 that connects to a top portion of the hood. In certain embodiments, the beard trimmer head attachment can include one or more cutting units constructed to cut hair that has a longer length and such that it will leave some hair remaining with the trimming function is completed. The beard trimmer head attachment is relatively more powerful than a shaver and/or one or more of the other types of hair grooming or skin treatment attachments. As described above, the beard trimmer head attachment may be constructed similar to the body hair trimmer and perform similar functions. See, for example, further description below with reference to the figures herein. However, in certain embodiments, the beard trimmer head attachment can include one or more cutters where the blade(s) are angled on one side for accurate beard contour or longer beard length.

As shown in FIG. 9, when the beard trimmer head attachment 20*d* (or body hair trimmer 20*c*) is engaged with the head base 18, the first driven shaft 46 inserts into the head attachment, but does not engage anything, and the second driven shaft 48 inserts into the head attachment 20*d* and engages the carrier 128. Thus, when the second driven shaft 48 reciprocates back and forth it causes the carrier to reciprocate, pivot, or rotate back and forth, driving the cutter blade 130 with a ratio of 1:1.

The beard trimmer head attachment 20*d* can also include a releasably engageable comb as conventionally known that can engage the cover and/or the hood. A plurality of combs (e.g., comb 136) may be available to releasably engage the beard trimmer head attachment, one at a time. Each comb may include a plurality of teeth 138 and provide a guard to limit a different length of hair trimmed from the body, thus providing multiple options for hair-trim length.

Figure 10:
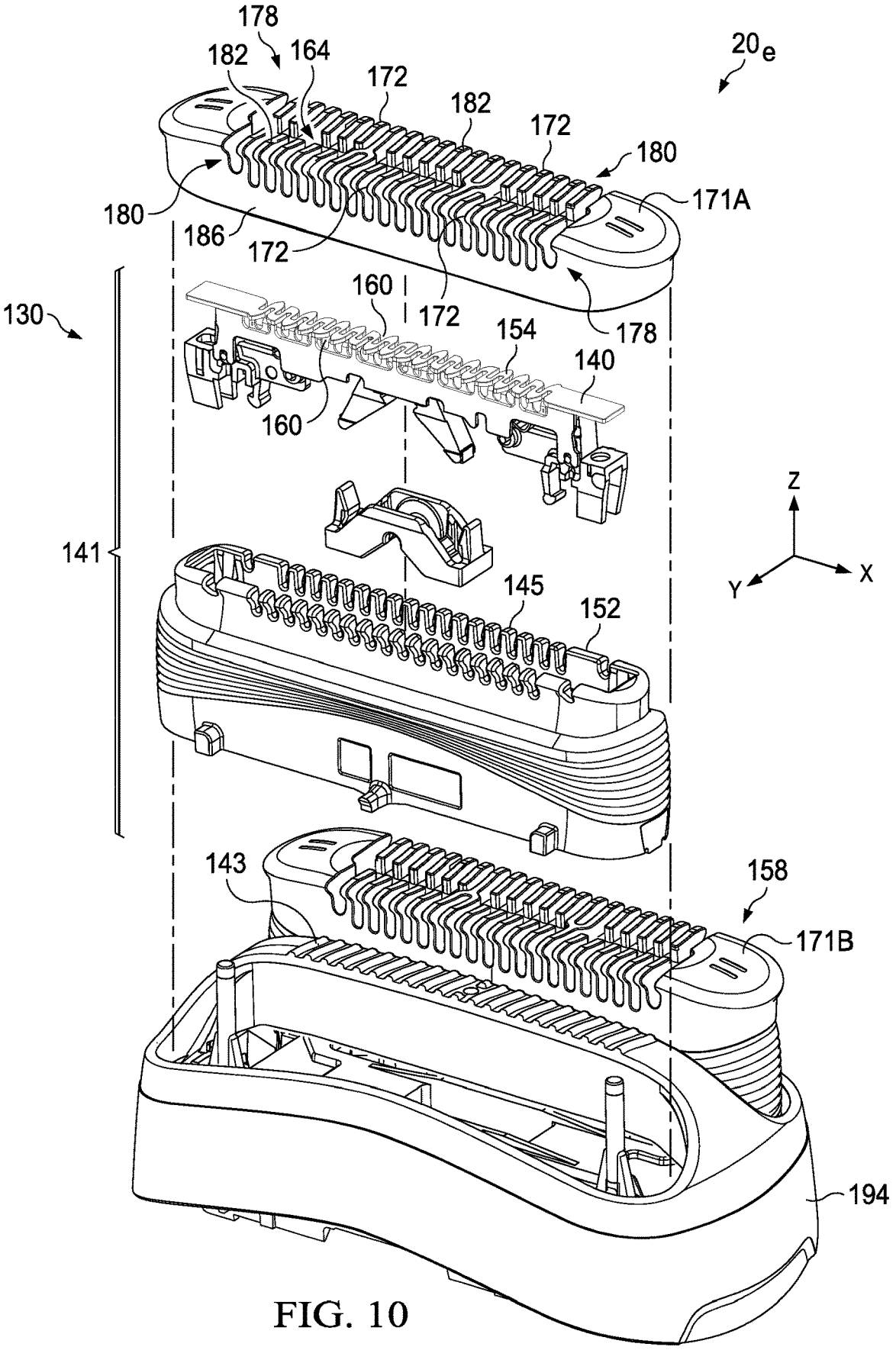
FIG. 10 depicts an exploded view of a cutting unit of a facial hair stubble trimmer head attachment, according to one or more embodiments.

Referring to FIGS. 10-12, the facial hair stubble trimmer head attachment 20*e* is shown. FIG. 10 is an exploded view of the facial hair stubble trimmer head attachment 20*e*. Referring to FIGS. 1-3, the first long hair cutter unit 130 can be provided with a first outer cutter 140 and a first inner cutter 150. The first outer cutter 140 can be a non-foil type cutter, with the motor 30 configured to drive the first inner cutter 150 to oscillate the first inner cutter 150 relative to the first outer cutter 140 in a direction along an x axis such that hair between the first inner cutter 150 and the first outer cutter 140 is cut. The first outer cutter 140 has a cutter skin contact surface 154 and multiple cutting slots 160 (FIG. 10), which are positioned both side by side and on the opposite sides of the first outer cutter 140. The first outer cutter 140 faces the first inner cutter 150 with its first inner cutting side (not shown). The first inner cutter 150 is provided with cutting edges adapted to cut hair in both opposite movement directions along the y axis.

The first comb unit 171A is selectably attachable to the first long hair cutter unit 130 to change the hair cutting length of the beard trimmer 102. The first comb unit 171A comprises comb elements 178 which, when the first comb unit 171A is attached to the first long hair cutter unit 130, are located adjacent to the multiple cutting slots 160 of the first outer cutter 140. As illustrated, the first comb unit 171A has multiple comb elements 178. Accordingly, when the first comb unit 171A is attached to the first long hair cutter unit 130, the comb elements 178 are positioned on each of the opposite sides of the first outer cutter 140. Each comb element 178 has a row 180 of comb teeth 172, with adjacent comb teeth 172 being separated by comb slots 177. The width of one of the comb slots 177 is in the x axis for the first comb unit 171A and is in the range of 0.3 mm to 2.2. mm, for example. The comb teeth 172 may have any suitable cross-sectional shape, such as a T-shaped cross-sectional shape or an L-shaped cross-sectional shape, among others. Each of the comb teeth 172 has a tooth skin contact surface 182 which is located on an elevated upper level relative to the cutter skin contact surface 154. The tooth skin contact surface 182 engages with the user's skin during use of the facial hair stubble trimmer head attachment 20*e* and prevents the cutter skin contact surface 154 from being brought into skin contact. A distance between the tooth skin contact surface 182 of the comb unit 171A and the first inner cutting side of the first outer cutter 140 defines the hair trimming length. An inner surface of the first comb unit 171A faces the cutter skin contact surface 154 and is opposite to the tooth skin contact surface 182. The inner surface of the first comb unit 171A may be spaced from the cutter skin contact surface 154 by a distance of less than 0.6 mm, or preferably less than 0.4 mm, or more preferably less than 0.3 mm.

Each of the first long hair cutter unit 130 and the second long hair cutting unit 158 are independently moveable with respect to the outer housing part 194. Such movability of the first long hair cutter unit 130 and the second long hair cutting unit 158 during the shaving process can provide for better efficiency, improved contour following, and increased uniformity in cutting length. Further, the first comb unit 171A detachably mounted to the first long hair cutter unit 130 are movable together, as is the third comb unit 171B detachably mounted to the second long hair cutting unit 158.

Referring to FIG. 13, the skin treatment head attachment 20*f* (e.g., exfoliating brush) is shown. The skin treatment head attachment 20*f* includes a skin treatment implement (e.g., a brush unit 200 for exfoliating a user's skin) that is constructed to engage and perform such type of treatment to the skin such as, for example, exfoliate the skin. Skin treatment implements may also, for example, include a corresponding implement to perform one or more of the following skin treatments: massaging, pore cleansing, abrading, surface cleansing, combinations thereof, or other conventional skin treatments. Specifically, the skin treatment head attachment 20*f* shown in FIG. 13 also includes the brush unit 200 rotatably coupled to the skin treatment head attachment 20*f*. The brush unit 200 can include a platform 206 having one or more bristles 201 extending from the platform. In certain embodiments, the brush unit 200 can also include a brush unit transmission 202, 204 that rotatably couples the platform 206 and bristles 201 (i.e., brush unit 200) to the one of the first or second driven shafts 46, 48. The brush unit transmission 202, 204, in certain embodiments, can translate the linear, reciprocating movement of the first or second driven shafts 46, 48 into rotating motion that rotates brush unit 200 (i.e., platform 206 and bristles 201). Such rotating motion can be in complete revolutions, i.e., 360° or in reciprocating half rotations, i.e., +180° and −180°.

In certain embodiments, brush unit transmission 202, 204 can be constructed to include a reduction gearing operable to adjust the rpm's of the first or second driven shaft in order to reduce or speed up the rpm's of the brush unit 200 relative to the coupled driven shaft.

The brush unit transmission 202, 204 and/or the reduction gearing may be coupled manually to a separate activation button (or the same activation button set forth above herein) or electrically to a separate microcontroller and an activation coupled to the microcontroller (or the same microcontroller and activation button set forth above herein) to activate such reduction gearing to adjust the rpm.

In certain embodiments, the skin implement head attachment 20*f* can include reduction gearing coupled to the first and second brush units 201*a* and 201*b* to adjust the speed (i.e., rpm) and/or the torque of the first brush unit 201*a* and the second brush unit 201*b* to improve the functional performance of the skin treatment head attachment 20*f*. In certain embodiments, the reduction gearing can include a plurality of gears. In certain embodiments, the reduction gearing can include a first gear 202 and a second gear 204 rotatably engaged with the first gear 202 to adjust the speed and torque of the first brush unit 201*a* and second brush unit 201*b*. The first gear 202 and the second gear 204 can be conventional gears (e.g., saw teeth gears). The first gear and second gear can be coupled to a microcontroller disposed upon a printed circuit board disposed within the handle. The microcontroller can be electrically activated by a user pressing an activation button disposed on the handle or head base. The activation of the activation button causes the gears 202 and 204 to engage and adjust the speed of the reciprocating (or oscillating) motion of the first and second brush units 201*a* and 201*b*, respectively.

While the head 16 shown and described above herein is capable of both swiveling and tilting movements relative to the handle 12 (three-dimensional movement), it will be appreciated that in certain embodiments, the head 16 can be fixed with respect to the handle 12. In certain embodiments, the head 16 (including head base 18 and one of the head attachments 20*a*, 20*b*, 20*c*, 20*d*, 20*e*, or 20*f* releasably engaged to the head base 18) may be fixed in all other directions relative to the handle other than the tilt motion about the first transverse axis $A_2$, i.e., the head may tilt, but is either permanently or temporarily prevented from swiveling about the second transverse axis $A_3$. Thus, the head 16 may be restricted to two-dimensional movement. In certain embodiments, such swiveling movement can be prevented by activating an electrically or manually-operated button. An electrically operated button can be coupled to the motor and electrical circuit to drive and move a lever to engage a non-pivoting component (e.g., the first support member 58) to prevent and/or block the swiveling of the head 16 about the second transverse axis $A_3$ relative to the handle 12. In certain embodiments, a manual push button is coupled to a lever to drive and move it such that it engages a non-pivoting component (e.g., the first support member 58) to prevent and/or block the swiveling of the head 16 about the second transverse axis $A_3$ relative to the handle 12.

Figure 14:
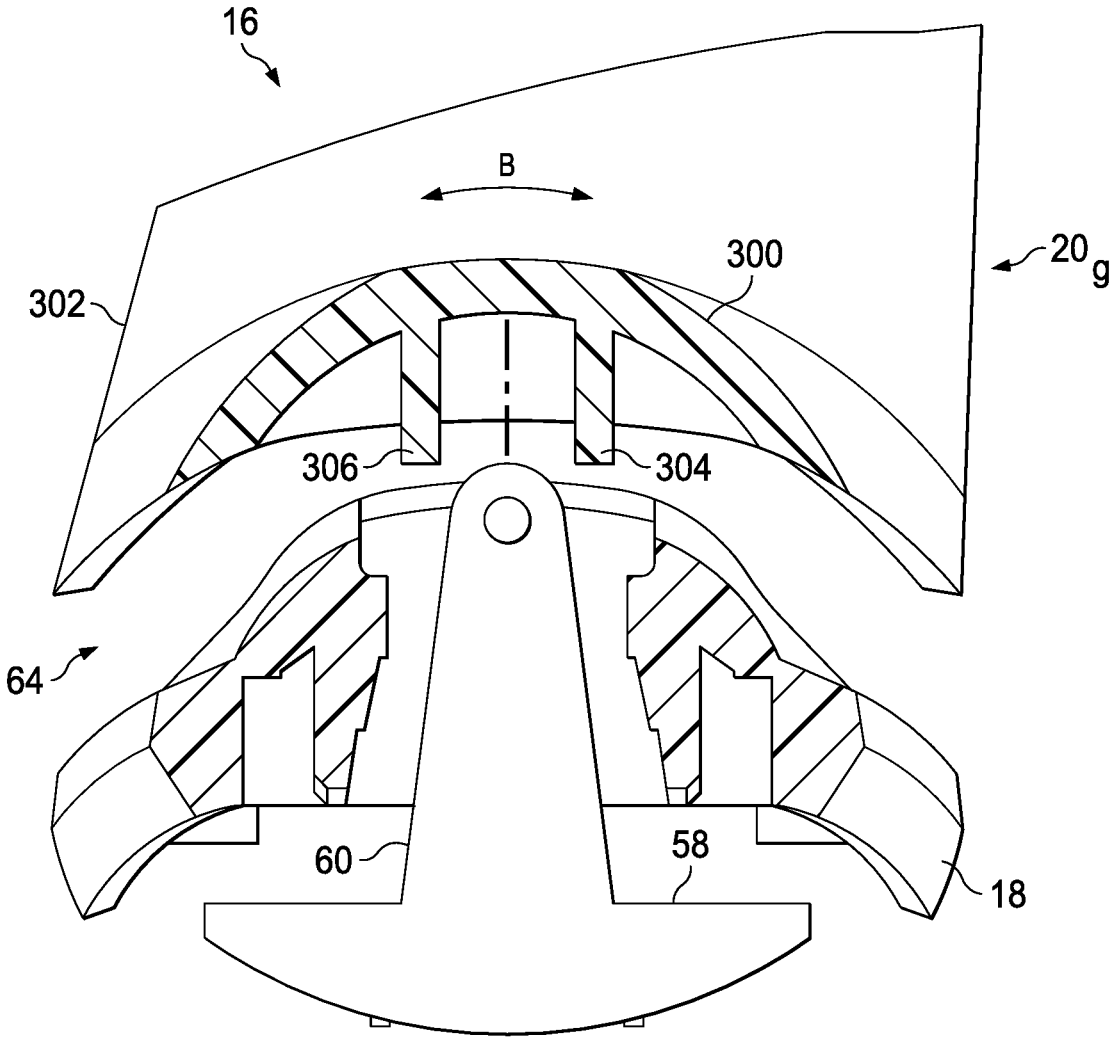
FIG. 14 depicts a side elevational view of a first support member, a head base coupled to the first support member and an anti-three dimensional movement head attachment disengaged from the head base, according to one or more embodiments.
Figure 15:
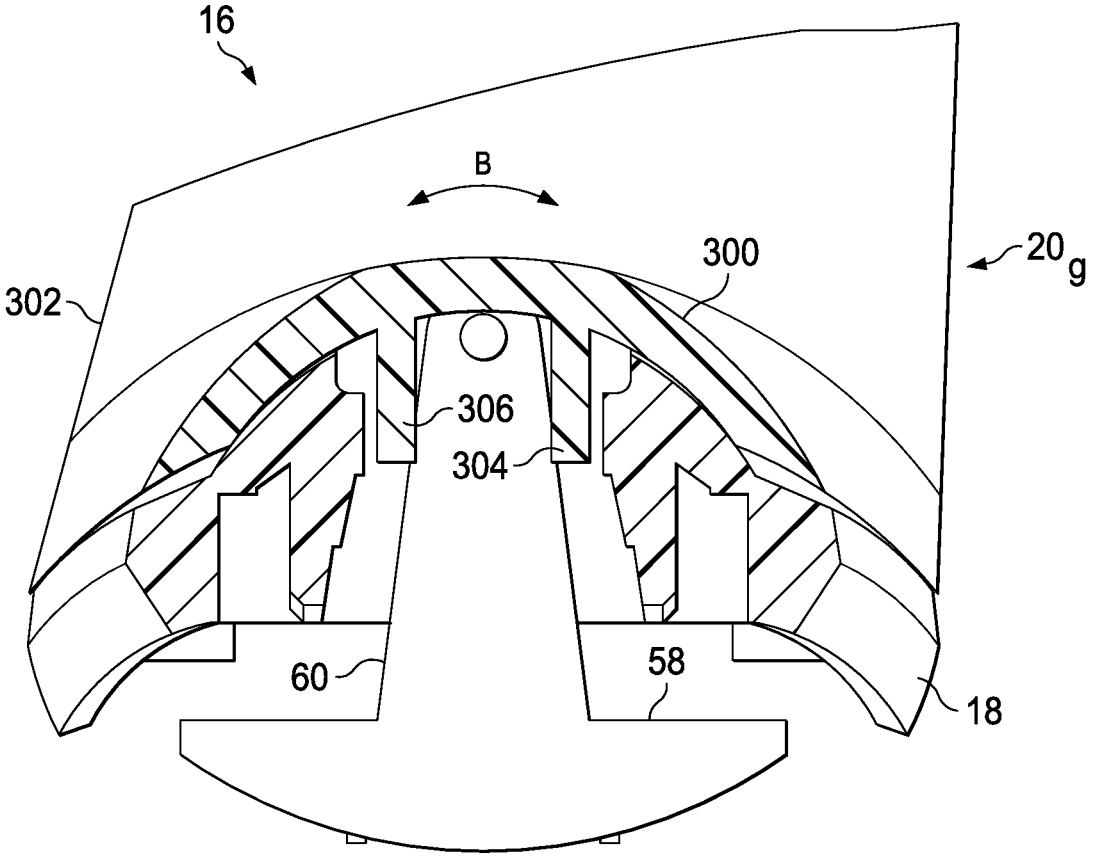
FIG. 15 depicts a side elevational view of the first support member, head base and anti-three dimensional movement head attachment of FIG. 14, wherein the anti-three dimensional movement head attachment is engaged with the head base, according to one or more embodiments.

In certain embodiments, the head 16 may tilt about the first transvers axis $A_2$ as indicated by arrow (A) and may, at times, swivel about the second transverse axis $A_3$ as indicated by arrow (B) and, at other times, be prevented from swiveling about the second transverse axis $A_3$ in FIG. 1 as will be shown and described below herein. As an example, an anti-three-dimensional movement head attachment 20*g* is shown in FIGS. 14 and 15. The anti-three-dimensional movement head attachment 20*g* may include a frame 300, a shroud 302 coupled to the frame 300, a first stop 304 extending from the head base 18 at the first end 64 of the head attachment, and a second stop 306 extending from the frame at the first end 64 and parallel to the first stop 304. As shown in FIG. 15, when the anti-three-dimensional movement head attachment 20*g* is releasably engaged with the head base 18, the first and second stops 304 and 306, respectively, at least partially encompass and engage first tab 60 of the first support member 58, preventing the head 16 from swiveling about the second transverse axis $A_3$ as indicated by arrow (B). In certain embodiments, a third stop (not shown) and a fourth stop (not shown) may extend from the lower frame 18 at a second end 66 of the head attachment, parallel to each other. When the anti-three-dimensional movement head attachment 20*g* is releasably engaged with the head base 18, the third and fourth stops along with the first and second stops 304 and 306, respectively, at least partially encompass and engage second tab 62 and first tab 60, respectively, of the first support member 58, preventing the head 16 from swiveling about the second transverse axis $A_3$ as indicated by arrow (B). It should be understood that anti-three-dimensional movement head attachment 20*g* may be combined and/or incorporated into any one of the other head attachments 20*a*-20*f* as set forth above.

In certain embodiments, the head 16 (including head base 18 and one of the head attachments 20*a*, 20*b*, 20*c*, 20*d*, 20*e*, or 20*f* releasably engaged to the head base 18) may be fixed in all other directions relative to the handle other than the swivel motion about the second transverse axis $A_3$, i.e., the head may swivel, but is either permanently or temporarily prevented from tilting about the first transverse axis $A_2$. Thus, the head 16 may be restricted to two-dimensional movement. An electrically operated button can be coupled to the motor and electrical circuit and/or microcontroller to drive and move a stop to engage a non-pivoting component (e.g., the first support member 58) to prevent and/or block the tilting of the head 16 about the first transverse axis $A_2$ relative to the handle 12. In certain embodiments, a manual push button is coupled to a stop to drive it such that it engages a non-pivoting component (e.g., the first support member 58) to prevent and/or block the tilting of the head 16 about the first transverse axis $_{A2}$ relative to the handle 12. It is appreciated that one or more of the stops shown and described above herein may extend from the head base, head attachment, and/or the handle in order to prevent movement of the head in a third dimension relative to the handle.

In certain embodiments, the head 16 may tilt about the first transvers axis $A_2$ as indicated by arrow (A) and may, at times, swivel about the second transverse axis $A_3$ as indicated by arrow (B) and, at other times, be prevented from tilting about the first transverse axis $A_2$ in FIG. 1 as will be shown and described below herein.

As set forth above, one of a plurality of head attachments 20*a*-20*g*, at one time, can be releasably engageable with and/or releasably attachable to the head base 18. As an example, any one of the plurality of head attachments 20*a*-20*g* such as, for example, shaver head attachment 20*a*, may be solely releasably engaged with and/or releasably attached to the head base 18 and thus releasably engaged and/or releasably attached to the electronically-driven device 10. The attached head attachment, for example, shaver head attachment 20*a*, may be disengaged or disconnected from the head base 18 and another one of the plurality of head attachments 20*a*-20*g* such as, for example, skin treatment head attachment 20*f*, may be releasably engaged and/or releasably attached to the same head base 18 and thus releasably engaged and/or releasably attached to the same electronically-driven device 10. As further example, the skin treatment head attachment 20*f* may be disengaged from the head base 18 and another one of the plurality of head attachments such as, for example, facial hair stubble trimmer head attachment 20*e*, may be releasably engaged with and/or releasably attached to head base 18 and thus releasably engaged and/or releasably attached to the same electronically-driven device 10. Thus, eliminating the need for multiple electronically-driven devices for every hair grooming and skin treatment need and/or purpose.

Each of the head attachments shown and described herein may include a skin treatment implement and/or one or more cutting elements that can be constructed to contact skin or hair of the user's face, neck, or other areas of the user's body. The skin treatment implement and/or one or more cutting elements can include one or more cutting units. In certain embodiments, and as depicted in FIG. 2, the one or more cutting units can include a first blade-type inner cutting unit 22, a second blade-type inner cutting unit 24, and a center cutting unit 26. The center cutting unit 26 can be a non-foil-type cutting unit. However, it will be appreciated that a skin-engaging portion can include other suitable cutting units in any of a variety of suitable configurations.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. An electrically-driven device, the device comprising:

a handle;

a head, the head comprising:

a head base being coupled to the handle and movable in at least two dimensions relative to the handle, and a first head attachment and a second head attachment, only one of the first head attachment and the second head attachment being engageable with the head base at a time, wherein:

each one of the first and second head attachments is releasably engageable, one at a time, with the head base, each one of the first and second head attachments includes a skin treatment implement constructed to treat skin or a cutting unit constructed to cut hair, the first head attachment is different from the second head attachment, if one of the first or the second head attachment comprises the skin treatment implement, then the skin treatment implement comprises a skin treatment implement head attachment and if one of the first or the second head attachment comprises the cutting unit, then the cutting unit comprises one of a shaver head attachment, a long-hair trimmer head attachment, a body hair trimmer head attachment, a beard trimmer head attachment, or a facial hair stubble trimmer head attachment;

at least one driven shaft, the at least one driven shaft extending into the head and coupled to and driving the skin treatment implement or the cutting unit, wherein the at least one driven shaft comprises a first driven shaft and a second driven shaft, wherein the first and second driven shafts reciprocate in opposite directions;

a motor, the motor being contained substantially within the handle; and a transmission, the transmission being constructed to translate rotary motion of the motor to linear, reciprocating motion of the at least one driven shaft.

2. The electrically-driven device according to claim 1, wherein the head is movable in two or three dimensions relative to the handle.

3. The electrically-driven device according to claim 1, further comprising at least one of a third head attachment, a fourth head attachment, a fifth head attachment, a sixth head attachment, or a seventh head attachment, wherein each of the third head attachment, fourth head attachment, fifth head attachment, sixth head attachment, and a seventh head attachment comprises one of a shaver head attachment, a long-hair trimmer head attachment, a body hair trimmer head attachment, a beard trimmer head attachment, a facial hair stubble trimmer head attachment, a skin treatment implement head attachment, or an anti-three-dimensional movement head attachment.

4. The electrically-driven device according to claim 1, further comprising a link mechanism coupling the head to the handle such that the head tilts about a first transverse axis relative to the handle.

5. The electrically-driven device according to claim 4, wherein the link mechanism is a four link mechanism, each link has an upper portion movably coupled to the head and a lower portion movably coupled to the handle.

6. The electrically-driven device according to claim 1, wherein the handle comprises a first support member coupling the head to the handle such that the head swivels about a second transverse axis relative to the handle.

7. The electrically-driven device according to claim 6, wherein the first support member comprises a first tab and a second tab, and wherein the head comprises a first end swivelably coupled to the first tab and a second end swivelably coupled to the second end.

8. The electrically-driven device according to claim 1, further comprising a stop that engages both the head and handle, preventing the head from moving in a one dimension or a third dimension.

9. The electrically-driven device according to claim 1, wherein each of the first and second head attachments comprises:

a frame being releasably engageable with the head base; and a hood, the hood being releasably engageable with at least one of the head base or the frame.

10. The electrically-driven device according to claim 1, wherein the first head attachment further comprises a post extending from the frame and a rocking arm pivotally coupled to the post and having a first end and a second end, the rocking arm being releasably engageable, at the first end, to one of the first driven shaft or the second driven shaft, and at the second end, to a cutter of the first head attachment, such that the rocking arm translates reciprocating motion of one of the first driven shaft or the second driven shaft to the cutter.

11. The electrically-driven device according to claim 9, wherein the first head attachment comprises the cutting unit.

12. The electrically-driven device according to claim 11, wherein the first head attachment is a shaver and the cutting unit is a foil-type cutting unit.

13. The electrically-driven device according to claim 1, wherein the first head attachment further comprises a carrier that couples one of the first driven shaft or second driven shaft to a cutter.

14. The electrically-driven device according to claim 1, the first head attachment or second head attachment further comprises one or more distance combs that are releasably engageable with the first head attachment or second head attachment.

15. The electrically-driven device according to claim 1, wherein each of the first head attachment and second head attachment further comprises one or more snap-fit joints and the head base comprises one or more corresponding snap-fit joints constructed to couple to the respective one or more snap-fit joints of the first head attachment and second head attachment.

16. The electrically-driven device according to claim 1, wherein the transmission is constructed to translate rotary motion of the motor to reciprocating pivoting movement of an intermediate element of the transmission to linear, reciprocating motion of the at least one driven shaft.

17. An electrically-driven device, the device comprising:

a handle;

a head, the head comprising:

a head base being coupled to the handle and movable in at least two dimensions relative to the handle, and a first head attachment and a second head attachment, only one of the first head attachment and the second head attachment being is engageable with the head base at a time, wherein:

each one of the first and second head attachments is releasably engageable, one at a time, with the head base, the first head attachment includes a skin treatment implement comprising a brush unit and the second head attachment includes a cutting unit constructed to cut hair, the first head attachment is different from the second head attachment, and the cutting unit comprises one of a shaver head attachment, a long-hair trimmer head attachment, a body hair trimmer head attachment, a beard trimmer head attachment, or a facial hair stubble trimmer head attachment;

at least one driven shaft, the at least one driven shaft extending into the head and coupled to and driving the skin treatment implement or cutting unit, wherein the at least one driven shaft comprises a first driven shaft and a second driven shaft, wherein the first and second driven shafts reciprocate in opposite directions;

a motor, the motor being contained substantially within the handle; and a transmission, the transmission being constructed to translate rotary motion of the motor to linear, reciprocating motion of the at least one driven shaft.

* * * * *